US007632158B2

(12) United States Patent
Denpouya et al.

(10) Patent No.: US 7,632,158 B2
(45) Date of Patent: Dec. 15, 2009

(54) CABLE CONNECTOR AND CONNECTOR ASSEMBLY

(75) Inventors: Ikuo Denpouya, Tokyo (JP); Tsuyoshi Sakata, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 12/213,926

(22) Filed: Jun. 26, 2008

(65) Prior Publication Data

US 2009/0004924 A1 Jan. 1, 2009

(30) Foreign Application Priority Data

Jun. 29, 2007 (JP) ..... 2007-171313

(51) Int. Cl.
*H01R 13/512* (2006.01)

(52) U.S. Cl. ..... 439/752; 439/488

(58) Field of Classification Search ..... 439/752, 439/488, 489, 596

See application file for complete search history.

(56) References Cited

U.S. PATENT DOCUMENTS 5,575,692 A * 11/1996 Cecil et al. ..... 439/752
6,149,462 A * 11/2000 Sugie ..... 439/595
2004/0110427 A1* 6/2004 Shi et al. ..... 439/752

FOREIGN PATENT DOCUMENTS

| | | |
|---|---|---|
| JP | 05-017949 U | 3/1993 |
| JP | 11-086971 | 3/1999 |
| JP | 11-162549 | 6/1999 |
| JP | 2002-033150 | 1/2002 |

* cited by examiner

*Primary Examiner*—Ross N Gushi
(74) *Attorney, Agent, or Firm*—Kubotera & Associates, LLC

(57) ABSTRACT

A cable connector is to be fitted to a mating connector attached to a circuit board. The cable connector includes a housing including a terminal hole for inserting a cable with a terminal; and a movable member attached to the housing for positioning the terminal at a regular position. The movable member includes an attached portion attached to the housing and a pressing portion retained in the terminal hole to be movable to an advance position for positioning the terminal at the regular position. The attached portion includes an upper plate portion and a lower plate portion both extending forward from a rear wall portion of the movable member to be guided along a top wall of the housing. The pressing portion includes a thrust arm portion extending forward from the rear wall portion and having a pressing surface on a front edge surface thereof.

14 Claims, 13 Drawing Sheets

CABLE CONNECTOR AND CONNECTOR ASSEMBLY

BACKGROUND OF THE INVENTION AND RELATED ART STATEMENT

The present invention relates to an electrical connector for a cable (hereinafter called "a cable connector") and a connector assembly having a connector for a circuit board (hereinafter called "a circuit board connector") and the cable connector. The circuit board connector is attached to a circuit board and is fitted to the cable connector.

Patent Reference has disclosed a conventional female connector. A terminal with a cable is attached to the female connector that is fitted to a male connector. A retainer is attached to a housing of the female connector to be movable so as to secure an attachment position of the terminal with a cable.

Patent Reference: Japanese Patent Publication No. 11-86971

The conventional female connector disclosed in Patent Reference has a housing body, the retainer, the terminal with a cable, and a locking member. A recessed portion is formed in the housing body. The retainer is attached to the recessed portion as a movable member. The terminal with a cable is held in the housing and the retainer.

The conventional female connector is assembled as follows. First, the retainer is inserted at a temporary locking position from a rear portion of the housing body to an inside of the recessed portion. Next, the terminal with a cable is inserted in the retainer and the housing body. Further, the retainer is moved upward up to a locking position inside of the recessed portion. Finally, the locking member is attached from behind the housing body. As described above, the terminal with a cable is held at a regular position to be completely inserted.

In the conventional female connector, there can be a case in which the terminal with a cable is not inserted up to the regular position. In this case, the retainer does not reach the locking position. Accordingly, the locking member cannot be attached to a specific position. That is, the locking member cannot be attached to the specific position at the end of the assembly procedure. Accordingly, the terminal with a cable is not at the regular position and is inserted incompletely.

In this case, it is necessary to disassemble the female connector, and the assembly operation has to be repeated from the beginning.

In the female connector disclosed in Patent Reference, the retainer and the locking member are required to attach the terminal with a cable to the housing body at the regular position, thereby increasing manufacturing cost and part management cost.

Further, after the retainer is moved to the temporary locking position and then to the locking position to assemble the female connector, the locking member must be incorporated. That is, three steps are required to assemble the female connector.

Further, when the terminal with a cable is at a position to be incompletely inserted, the incomplete insertion is not visually confirmed until the locking member is attached at the end. At that time, the female connector must be disassembled to repeat the assembly operation. This is a time consuming operation and leads to an increase of the production cost.

In view of the above problems, an object of the present invention is to provide a cable connector and a connector assembly that comprises the cable connector and a mating connector or a circuit board connector.

The cable connector of the invention is formed of a small number of parts and is easy to assemble. Further, when a terminal with a cable is incompletely inserted, it is possible to continue an assembly of the cable connector while the terminal is completely inserted, thereby reducing a manufacturing cost.

Further objects and advantages of the invention will be apparent from the following description of the invention.

SUMMARY OF THE INVENTION

In order to attain the object described above, according to a first aspect of the present invention, a cable connector is fitted to a circuit board connector or a mating connector that is attached to a circuit board in a fitting direction that is perpendicular to the circuit board. A terminal with a cable is inserted in a terminal hole of a housing in a longitudinal direction of the cable. Further, a movable member is attached to the housing from a cable side to bring the terminal to a regular position.

In the cable connector, the movable member has an attached portion and a pressing portion. The attached portion is attached to the housing. The pressing portion enters the terminal hole when the movable member is attached and can move to an advance position that corresponds to the regular position of the terminal. The attached portion has an upper plate portion and a lower plate portion. The upper plate portion and the lower plate portion extend forward from a rear wall portion of the movable member and are guided in a front-to-back direction along a top wall of the housing. The pressing portion is formed as a thrust arm portion. The thrust arm portion extends from the rear wall portion to a front portion and has a pressing surface on a front edge surface thereof.

According to the present invention with the above configurations, the terminal with a cable is inserted in the terminal hole of the housing up to the regular position. Further, the movable member is attached to hold the terminal at the regular position. When the terminal is not completely inserted and does not reach the regular position, the movable member advances to a specific position so that a pressing surface of the pressing portion pushes forward and automatically moves the terminal to the regular position.

When the movable member advances, the upper plate portion and the lower plate portion of the movable member are guided by a top face and a lower face of the top wall of the housing, respectively. When the movable member reaches the specific advance position, the attached portion is attached to the housing. The upper plate portion and the lower plate portion are guided to sandwich the top wall of the housing, which enables a stable advancement.

In the present invention, it is preferred that the movable member has a position display portion in the lower plate portion thereof. The position display portion shows a position of the pressing portion in a front-to-back direction in a lower portion of the top wall of the housing.

Further, it is preferred that the housing has a confirmation portion on the top wall as a cut portion or a window portion. The confirmation portion enables an operator to visually confirm the position display portion when the pressing portion reaches the advance position. The visual confirmation of the position display portion in the confirmation portion means that the pressing portion of the movable member reaches the advance position or that the terminal is completely inserted in the regular position.

The position display portion may be a protrusion that locks to the confirmation portion. In this case, the protrusion locks to the confirmation portion so that the advance position of the movable member is maintained.

According to the present invention, the housing may be provided with a locking arm on a front edge side thereof. The locking arm is flexible in a front-to-back direction. The locking arm extends in a fitting direction with the mating connector and locks with the mating connector at a locking hook that protrudes backward on the distal side in the direction thereof. Accordingly, an external force is applied backward to an operating portion of the locking arm so that the lock may be released.

According to the present invention, the movable member may be arranged to retreat for a specific distance from the advance position. The upper plate portion of the movable member covers the confirmation portion of the housing at a retreat position. Accordingly, it is confirmed that the movable member is at the retreat position. In this case, when the rear wall portion of the movable member has a pressed portion, the movable member becomes movable forward from the retreat position by receiving an operating force in the pressed portion.

When the pressed portion is provided at a position behind the locking arm, a knob operation to apply an operating force forward to the pressed portion and backward to the locking arm at the same time while fitting to the mating connector enables the movable member to advance and unlocks the locking arm at a single operation. Accordingly, the cable connector can be easily pulled out from the mating connector.

According to a second aspect of the present invention, a connector assembly comprises the electrical cable connector and the electrical circuit board connector. The electrical cable connector is fitted to the circuit board connector or the mating connector that is attached to the circuit board.

In the electrical cable connector, the terminal with a cable is inserted forward to the terminal hole of the housing in a longitudinal direction of the cable. Moreover, in the electrical cable connector, the movable member is attached to the housing to support the terminal at the regular position. The electrical circuit board connector is attached to the circuit board.

In the connector assembly according to the present invention, the movable member of the electrical cable connector has the attached portion and the supporting portion. The attached portion is attached to the housing. The supporting portion enters the terminal hole upon attachment of the movable member so as to support the terminal at the regular position.

Further, a fitting portion that is connected with the electrical cable connector is formed in the housing of the electrical circuit board connector. When the electrical cable connector is incompletely fitted to the electrical circuit board connector, a part of the movable member is adjacent to a barrier portion of the housing of the electrical circuit board connector to prevent a movement of the movable member. When the electrical cable connector is completely fitted to the electrical circuit board connector, a movement of the movable member is allowed in the connector assembly.

In the present invention, the cable connector is fitted to the fitting portion of the circuit board connector. When the fitting of the cable connector and the circuit board connector is complete, the movable member moves to the specific position. When the fitting of the cable connector and the circuit board connector is incomplete, the movable member is adjacent to the barrier portion of the housing of the circuit board connector and does not move to the specific position, which may indicate that the fitting is incomplete.

It is preferred that the fitting portion of the housing of the electrical circuit board connector is formed as a receiving recess portion. The receiving recess portion receives the electrical cable connector in a direction perpendicular to a surface of the circuit board while the cable of the electrical cable connector is parallel to the circuit board.

The movable member may be arranged to move backward when the electrical cable connector is completely fitted to the electrical circuit board connector. In this case, it is preferred that the barrier portion is provided with a guide portion. The guide portion guides a guided portion that is formed in a part of the movable member from the advance position to the retreat position.

Further, it is preferred that the guide portion is provided with a retreat regulation surface and an upper regulation surface. The retreat regulation surface is adjacent to a rear side of the guided portion at the retreat position. The upper regulation surface is adjacent to a top face of the guided portion.

Accordingly, when the cable connector is completely fitted to the circuit board connector, the guided portion of the movable member is guided at the guide portion of the circuit board connector to retreat and the rear side of the guided portion is adjacent to the retreat regulation surface at the specific position. The movable member does not retreat further.

Further, when the movable member retreats to the specific position, the top face of the guided portion cannot move upward due to the upper regulation surface. Accordingly, the cable connector is prevented from coming off upward.

It is preferred that the barrier portion has the guide portion. The guide portion guides the guided portion that is formed in a part of the movable member from the advance position to the retreat position of the movable member. Further, it is preferred that at least one of the guide portion of the barrier portion and the guided portion of the housing has a guide slope. The guide slope facilitates a retreat of the guided portion. Accordingly, when the movable member retreats, the guided portion of the movable member is guided toward the retreat position by the guide slope, which facilitate that the movable member is retreated while being guided at the guide portion of the circuit board connector.

It is preferred that the barrier portion is provided with a slope. The slope is adjacent to a rear portion of the movable member during a fitting process of the electrical cable connector to the fitting portion when the movable member of the electrical cable connector has not reached the advance position. Further, it is preferred that a pressing force is applied from the slope so that the movable member moves to the advance position during the fitting process.

In the present invention, the cable connector is fitted to the circuit board connector after the terminal moves to the regular position due to an insertion of the movable member. At this time, there can be a case in which the terminal is not completely inserted in the regular position and the movable member does not reach the advance position in the cable connector. In this case, when the cable connector is fitted to the circuit board connector, the slope that is formed in the barrier portion of the circuit board connector pushes the movable member forward as the fitting progresses. Accordingly, the movable member advances the terminal to the regular position before the fitting is completed.

Even when the terminal is not completely inserted before the cable connector and the circuit board connector are fitted together, the terminal automatically advances to the regular position due to the fitting of the cable connector and the circuit board connector. In other words, the fitting operation of the cable connector and the circuit board connector can continue without repeating a process to attach the terminal in the cable connector from the beginning.

The movable member may be arranged to move forward when the electrical cable connector is completely fitted to the electrical circuit board connector. In this case, it is preferred that the barrier portion is provided with the guide portion. The guide portion guides the guided portion that is formed in a part of the movable member from the retreat position to the advance position of the movable member.

Further, it is preferred that the guide portion is provided with an advance regulation surface and the upper regulation surface. The advance regulation surface is adjacent to a front side of the guided portion in the advance position. The upper regulation surface is adjacent to the top face of the guided portion.

Accordingly, when the cable connector is completely fitted to the circuit board connector, the guided portion of the movable member is guided at the guide portion of the circuit board connector to advance. Further, the front side of the guided portion is adjacent to the advance regulation surface at a specific position and does not advance further. Further, when the movable member advances to the specific position, the top face of the guided portion does not move upward of the upper regulation surface. Accordingly, the cable connector is prevented from coming off upwardly.

It is preferred that one of the movable member of the cable connector and the circuit board connector includes a guide protruding bar portion and the other has a guide groove that conforms to the guide protruding bar portion. Further, it is preferred that the guide groove guides the guide protruding bar portion when the movable member moves. Accordingly, when the movable member moves, the guide protruding bar portion is guided by the guide groove so that the movable member may be moved smoothly.

It is preferred that one of the movable member of the cable connector and the housing of the electrical cable connector has the guide protruding bar portion and the other has the guide groove that conforms to the guide protruding bar portion. Further, it is preferred that the guide groove guides the guide protruding bar portion when the movable member moves. Accordingly, the guide protruding bar portion is guided by the guide groove when the movable member moves, and the movable member may move smoothly.

In the cable connector according to the present invention, when the movable member is inserted in a direction in which the housing of the terminal with a cable is inserted in the terminal hole, the terminal is pressed by the pressing portion of the movable member and automatically moves to the regular position. Accordingly, the number of components is limited and the operation is done easily and surely.

When the movable member is not completely inserted and the terminal is at a position to be incompletely inserted, the movable member receives a pressing force from the barrier portion of the circuit board connector to advance automatically, so that the terminal moves to the regular position during the process that the cable connector is fitted to the circuit board connector of the connector assembly. Accordingly, it is not necessary to repeat an operation to attach the terminal again. The operation is effectively performed and the connection of the cable connector and the circuit board connector is ensured.

BRIEF DESCRIPTION OF THE DRAWINGS

FIGS. 2(A) to 2(C) are views showing the movable member according to the first embodiment of the present invention, wherein FIG. 2(A) is a plan view thereof, FIG. 2(B) is a bottom view thereof, and FIG. 2(C) is a sectional bottom view thereof taken along a centerline thereof;

FIGS. 3(A) and 3(B) are perspective views showing the housing of the cable connector with the cable terminal attached thereto according to the first embodiment of the present invention, wherein FIG. 3(A) is a view of the housing in a state before the movable member is attached thereto, and FIG. 3(A) is a view of the housing in a state after the movable member is attached thereto;

FIGS. 4(A) to 4(C) are perspective views showing the cable connector and a circuit board connector or a mating connector according to the first embodiment of the present invention, wherein FIG. 4(A) is a view showing a state before the cable connector is fitted to the circuit board connector, FIG. 4(B) is a view showing a state that the movable member is situated at an advance position after the cable connector is fitted to the circuit board connector, and FIG. 4(C) is a view showing a state that the movable member is situated at a retreat position after the cable connector is fitted to the circuit board connector;

FIGS. 5(A) to 5(C) are sectional views showing the cable connector and the circuit board connector in the state before the cable connector is fitted to the circuit board connector according to the first embodiment of the present invention, wherein FIG. 5(A) is a sectional view taken along a line A-A in FIG. 3(B), FIG. 5(B) is a sectional view taken along a line B-B in FIG. 3(B), and FIG. 5(C) is a sectional view taken along a line C-C in FIG. 3(B);

FIGS. 6(A) to 6(C) are sectional views showing the cable connector and the circuit board connector in the state that the movable member is situated at the advance position after the cable connector is fitted to the circuit board connector according to the first embodiment of the present invention, wherein FIG. 6(A) is a sectional view taken along a line A-A in FIG. 3(B), FIG. 6(B) is a sectional view taken along a line B-B in FIG. 3(B), and FIG. 6(C) is a sectional view taken along a line C-C in FIG. 3(B);

FIGS. 7(A) to 7(C) are sectional views showing the cable connector and the circuit board connector in the state that the movable member is situated at the retreat position after the cable connector is fitted to the circuit board connector according to the first embodiment of the present invention, wherein FIG. 7(A) is a sectional view taken along a line A-A in FIG. 3(B), FIG. 7(B) is a sectional view taken along a line B-B in FIG. 3(B), and FIG. 7(C) is a sectional view taken along a line C-C in FIG. 3(B);

FIGS. 9(A) and 9(B) are perspective views showing a connector assembly according to a second embodiment of the present invention, wherein FIG. 9(A) is a perspective view showing the connector assembly, and FIG. 9(B) is an enlarged perspective view showing a cable connector and a circuit board connector of the connector assembly;

FIGS. 10(A) and 10(B) are views showing a cable connector and a circuit board connector in a state before the cable connector is fitted to the circuit board connector according to a third embodiment of the present invention, wherein FIG. 10(A) is a perspective view of the cable connector and the circuit board connector, and FIG. 10(B) is a sectional view of the circuit board connector taken at a position of a terminal;

FIGS. 11(A) and 11(B) are views showing the cable connector and the circuit board connector in a state that a movable member is situated at a retreat position after the cable connector is fitted to the circuit board connector according to the third embodiment of the present invention, wherein FIG. 11(A) is a perspective view of the cable connector and the circuit board connector, and FIG. 11(B) is a sectional view of the circuit board connector taken at the position of the terminal;

FIGS. 12(A) and 12(B) are views showing the cable connector and the circuit board connector in a state that a movable member is situated at an advance position after the cable connector is fitted to the circuit board connector according to the third embodiment of the present invention, wherein FIG. 12(A) is a perspective view of the cable connector and the circuit board connector, and FIG. 12(B) is a sectional view of the circuit board connector taken at the position of the terminal.

DETAILED DESCRIPTION OF PREFERRED EMBODIMENTS

Hereunder, embodiments according to the present invention will be explained with reference to the accompanying drawings.

First Embodiment

A first embodiment of the present invention will be explained. In the embodiment, a cable connector and a circuit board connector are fitted together to form a connector assembly. A terminal with a cable or a cable terminal is attached to the cable connector. The circuit board connector is attached to a circuit board.

Figure 1:
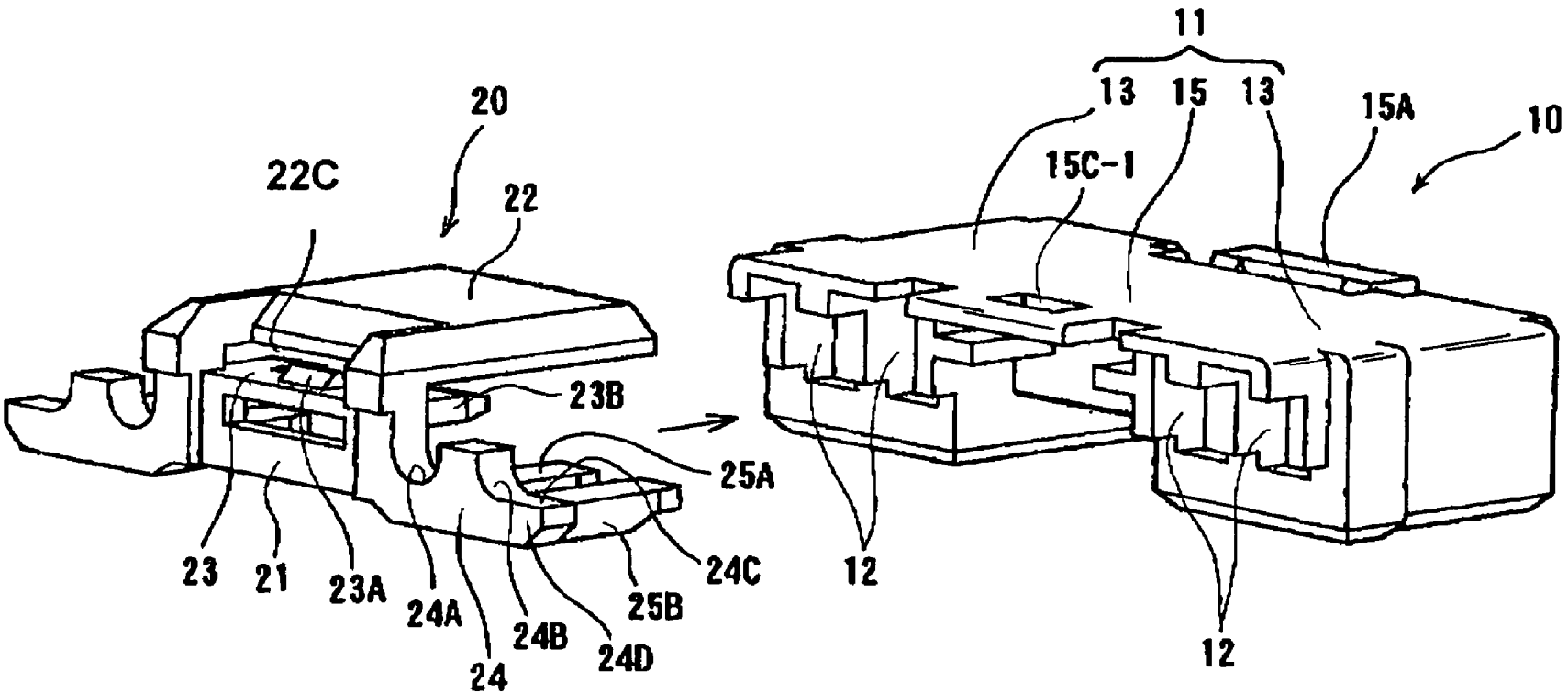
FIG. 1 is a perspective view showing a housing of a cable connector without a cable terminal and a movable member in a state before the movable member is attached to the housing according to a first embodiment of the present invention.

FIG. 1 is a perspective view showing a housing 11 of a cable connector 10 without a terminal with a cable and a movable member 20 to be attached to the housing 11 after the terminal is attached to the housing 11. FIG. 1 is a view showing a state before the movable member 20 is attached to the housing 11.

Figure 2:
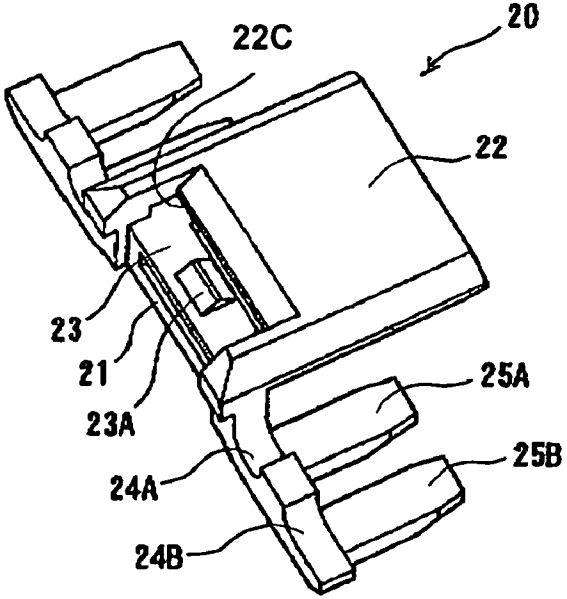
Figure 2:
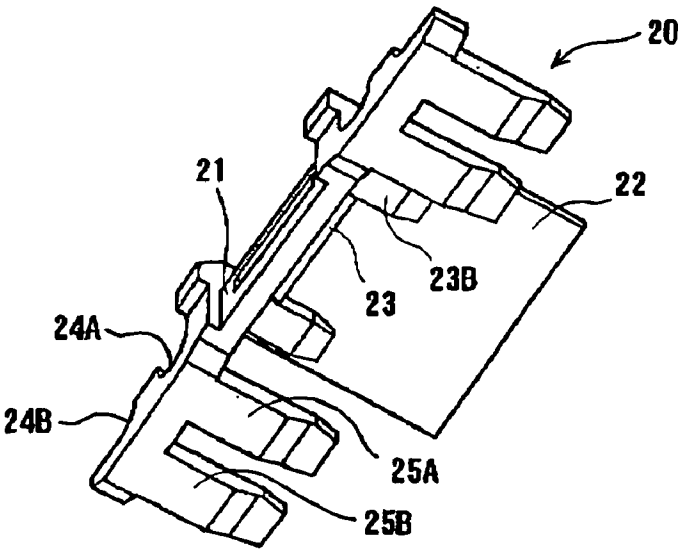
Figure 2:
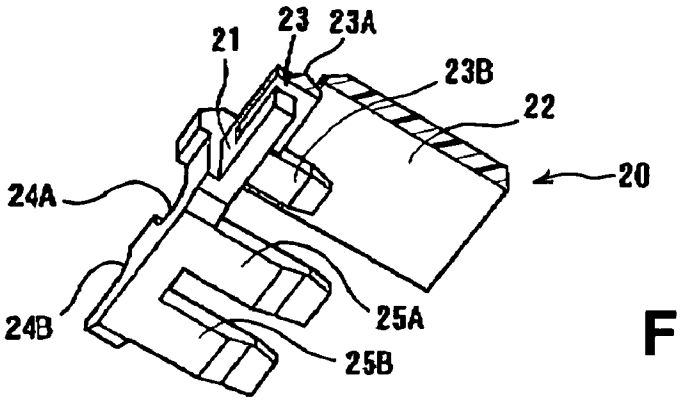

FIGS. 2(A) to 2(C) are views showing the movable member 20, wherein FIG. 2(A) is a plan view thereof, FIG. 2(B) is a bottom view thereof, and FIG. 2(C) is a sectional bottom view thereof taken along a centerline thereof.

Figure 3:
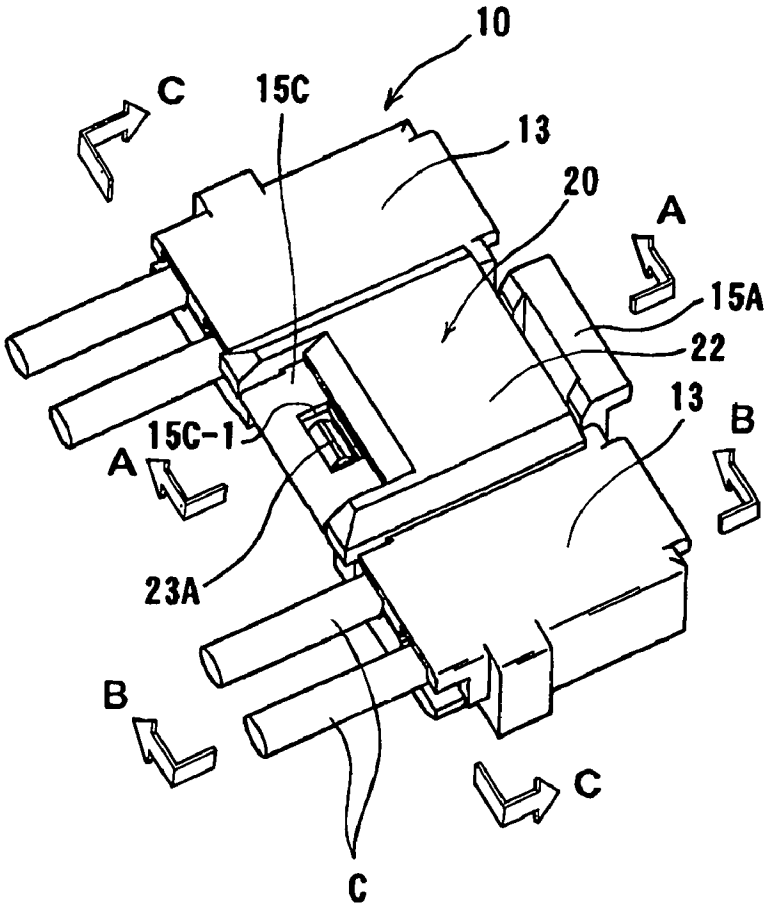
Figure 3:
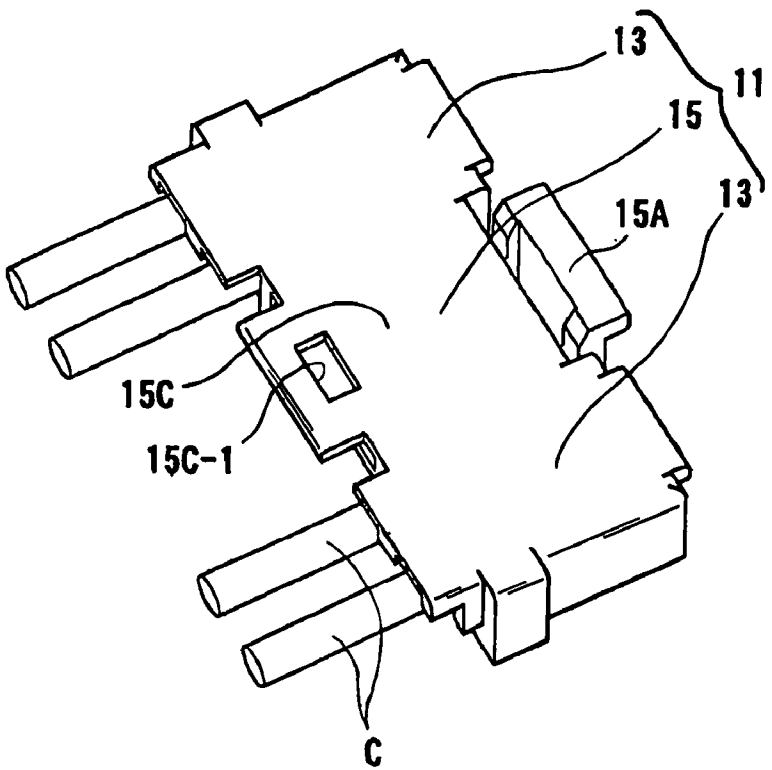

FIGS. 3(A) and 3(B) are perspective views showing the housing 11 of the cable connector 10 with the cable terminal attached thereto, wherein FIG. 3(A) is a view of the housing in a state before the movable member 20 is attached thereto, and FIG. 3(A) is a view of the housing in a state after the movable member 20 is attached thereto.

As shown in FIG. 1, the cable connector 10 is provided with two terminal holes 12 on both side areas on a rear side (surface on the side in which the movable member is positioned) of the housing 11. The housing 11 is made of an electrically insulation member to have a nearly rectangular outer shape. The terminal hole 12 is formed to be open and extend forward. A terminal with a cable C (not shown in FIG. 1) is inserted in each of the terminal holes 12 (shown in FIG. 3(A)). Further, the movable member 20 is attached to the terminal holes 12 to form the cable connector as shown in FIG. 3(B).

As shown in FIG. 1, the housing 11 has two connector portions 13 on right and left sides thereof. Further, the housing 11 has a connecting portion 15 that connects the connector portions 13. The connector portions 13 and the connecting portion 15 are integrally formed. The housing 11 is made to be symmetrical with respect to a vertical surface passing at a center of the connecting portion 15. Each of the connector portions 13 of the housing 11 includes the terminal hole 12 that is formed penetrating backward and frontward. The terminal holes 12 are parallel to each other.

Figure 5:
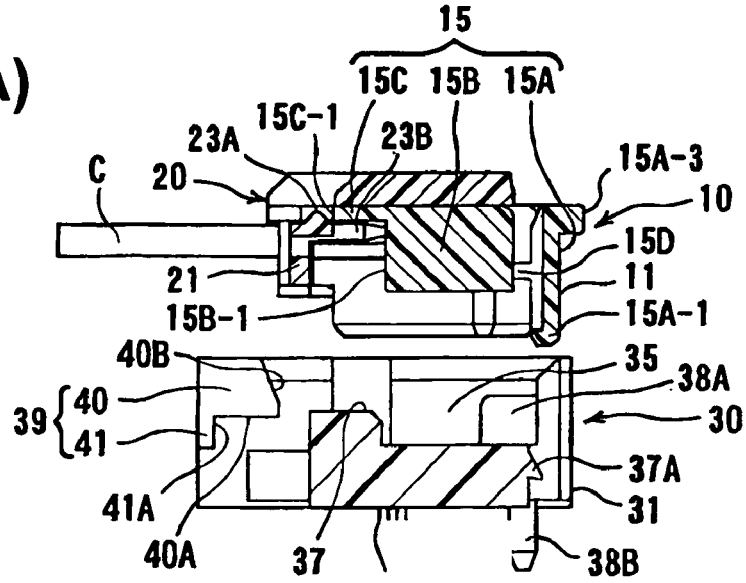
Figure 5:
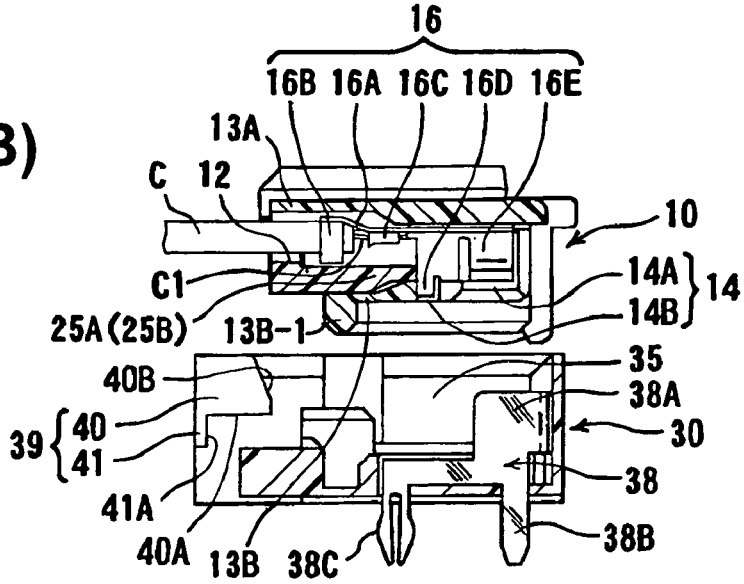
Figure 5:
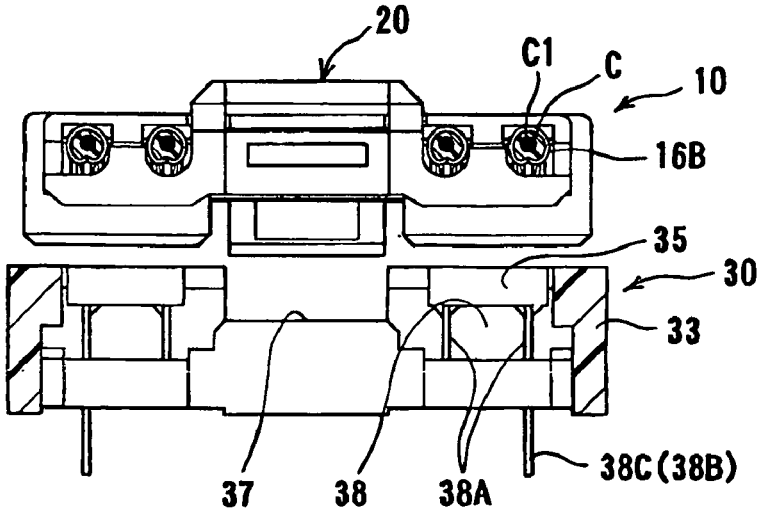

The terminal hole 12 is formed in the connector portion 13. As shown in FIG. 5(B), the terminal hole 12 penetrates from a rear side to a front side (left to right in the drawing) and opens downward in a front part of the connector portion 13. A rear edge of a top wall 13A of the connector portion 13 is formed to protrude backward with respect to a bottom wall 13B. The terminal hole 12 is tapered in a taper portion that is formed on a lower surface of the top wall 13A and a top face of the bottom wall 13B in a middle portion of a front-to-back direction. The terminal is guided and inserted in the taper portion.

In the embodiment, a fitting protruding portion 13B-1 that protrudes downward is formed on a rear edge side of the bottom wall 13B. A lower opening portion 14 of the terminal hole 12 has a terminal reception portion 14A on a front edge side, and a locking hole 14B that is situated behind the terminal reception portion 14A. The terminal reception portion 14A opens to receive a terminal of a mating connector from below. The locking hole 14B forms a space to lock a locking portion of the terminal to prevent the terminal with a cable from coming off. The terminal will be explained below.

As shown in FIG. 5(A), the connecting portion 15 of the housing 11 includes a locking arm 15A, a rigid portion 15B, and a top wall 15C. The locking arm 15A droops on a front edge side of the connecting portion 15 and is flexible. The rigid portion 15B is formed in a block shape at a middle portion of the connecting portion 15. The top wall 15C forms a space that opens downward on a rear portion side of the connecting portion 15. The locking arm 15A is flexible in a front-to-back direction.

In the embodiment, a locking hook 15A-1 is formed to face backward on a lower edge of the locking arm 15A and locks a corresponding portion of the mating connector. The locking arm 15A is connected with the rigid portion 15B through a fulcrum portion 15D. The fulcrum portion 15D is constricted between the locking arm 15A and the rigid portion 15B. The locking arm 15A has an operating portion 15A-3.

A front side of the operating portion 15A-3 forms an operation surface on an upper edge. The locking arm 15A is displaced to be in a lever shape in the fulcrum portion 15D when a backward force is applied in the operating portion 15A-3 thereof. Accordingly, the locking hook 15A-1 moves frontward to unlock. A rear side of the rigid portion 15B forms a front regulation surface 15B-1 that faces the movable member 20. The movable member 20 will be explained below. Further, a confirmation portion 15C-1 is formed on the top wall 15C. The confirmation portion 15C-1 is positioned at a middle position in a front-to-back direction and has a vertically arranged window shape.

A terminal 16 is pressure bonded to a cable C to obtain a terminal with a cable. As shown in FIG. 5(B), the terminal 16 is provided with a base portion 16A, a caulking portion 16B, a crimping portion 16C, a locking portion 16D, and a contact portion 16E in this order from a rear portion to a front portion thereof. The base portion 16A extends in a front-to-back direction. The caulking portion 16B is integrally formed with the base portion 16A. The caulking portion 16B is caulked to an outer cover of the cable C so as to hold the terminal 16 in the cable C (shown in FIG. 5(C)). The crimping portion 16C is pressure bonded or soldered to a core wire Cl of the cable C to be electrically connected with the core wire. The locking portion 14B constitutes a leg piece.

A lower edge of the locking portion 14B enters the locking hole 14B of the connector portion 13 to be locked in a front-to-bottom direction. The contact portion 16E receives and elastically sandwiches to contact with a contact portion of a terminal of the mating connector between both leg pieces thereof. The terminal 16 has a plate shape. The terminal 16 described above is publicly known and will not be further explained in detail.

As shown in FIG. 1, similar to the housing 11, the movable member 20 (also shown in FIGS. 2(A), 2(B), and 2(C)) is made of an electrically insulation member. The movable member 20 has a rear wall portion 21. The rear wall portion 21 is positioned on a rear edge side of the housing 11 when attached to the housing 11. An upper plate portion 22 and a lower plate portion 23 extend frontward from the rear wall portion 21. The rear wall portion 21, the upper plate portion 22, and the lower plate portion 23 form an attached portion with respect to the housing 11.

A cut portion 22A is opened on a rear side of the upper plate portion 22. When the upper plate portion 22 is viewed from above, the lower plate portion 23 is provided in a range that substantially corresponds to the cut portion 22A. The movable member 20 slides with the top wall 15C to be attached to the housing 11 while sandwiching the top wall 15C of the connecting portion 15 of the housing 11 between a lower surface of the upper plate portion 22 and a top face of the lower plate portion 23.

As described above, the upper plate portion 22 and the lower plate portion 23 function as a guided portion with respect to the top wall 15C of the housing. When the movable member 20 is attached to the housing 11, the upper plate portion 22 protrudes upward at a position of the connecting portion 15 in a middle portion of the housing 11. Accordingly, when the cable connector is fitted to the circuit board connector or the mating connector, the upper plate portion 22 forms a pressing portion. Further, the upper plate portion 22 can be used as a knob to move the movable member 20 conveniently.

A protrusion 23A as a position display portion is provided (shown in FIG. 5(A)) on the top face of the lower plate portion 23. The protrusion 23A is locked with the confirmation portion 15C-1 having a window shape when the movable member 20 is attached to a regular advance position. The confirmation portion 15C-1 is formed on the top wall 15C of the connecting portion 15.

In the embodiment, an abutting arm 23B extends frontward from each side of the lower plate portion 23 in a width direction thereof. Tips of the abutting arms 23B become adjacent to the front regulation surface 15B-1 or a rear side of the rigid portion 15B of the connecting portion 15 so as to determine an attachment position of the movable member 20.

An overhang portion 24 is provided in the rear wall portion 21 to extend in both directions thereof. Recessed curved portions 24A and 24B are formed on an upper edge of each of the overhang portions 24. The recessed curved portions 24A and 24B allow the cable C to extend. The cable C extends backward from the terminal 16 that is inside of the terminal hole 12.

In the embodiment, thrust arm portions 25A and 25B extend forward from a lower position of the recessed curved portions 24A and 24B. The thrust arm portions 25A and 25B form a pressing portion or a supporting portion. It is sufficient that the pressing portion has a portion to press instead of having an arm shape. The thrust arm portions 25A and 25B enter inside of the terminal hole 12 of the housing 11 when the movable member 20 is attached to the housing 11.

In the embodiment, tips of the thrust arm portions 25A and 25B contact a rear edge of the corresponding terminal 16 to push the terminal 16 frontward to a regular position due to the suppress strength. That is, even if the terminal 16 is not completely inserted, the terminal 16 is automatically advanced to the regular position when the thrust arm portions 25A and 25B advance to a specific position (hereinafter referred to as advance position).

In the embodiment, a pressing surface of a tip of each of the thrust arm portions 25A and 25B is adjacent to the terminal 16 that is in a position to be completely inserted. Accordingly, the pressing surface of the tip of each of the thrust arm portions 25A and 25B plays a role to determine an attachment position of the movable member 20 to be in the regular advance position along with the abutting arm 23B.

Figure 4:
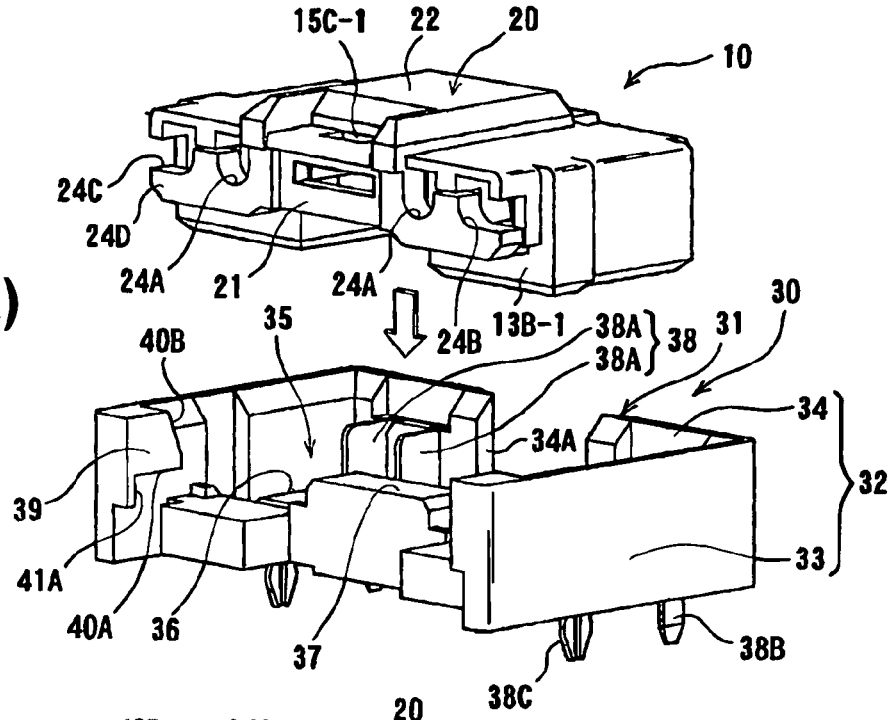
Figure 4:
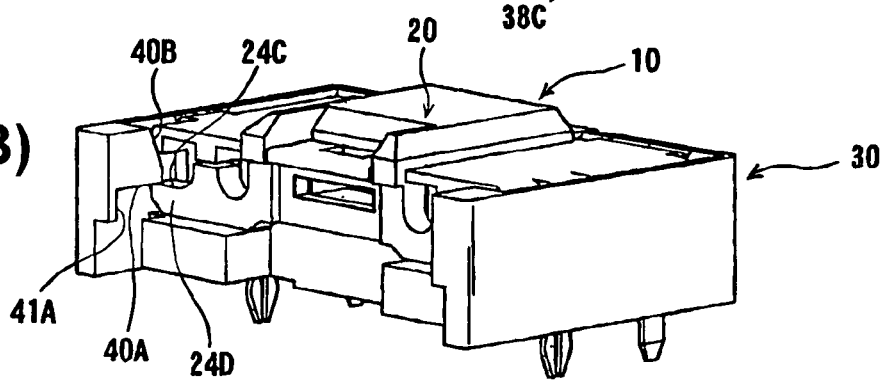
Figure 4:
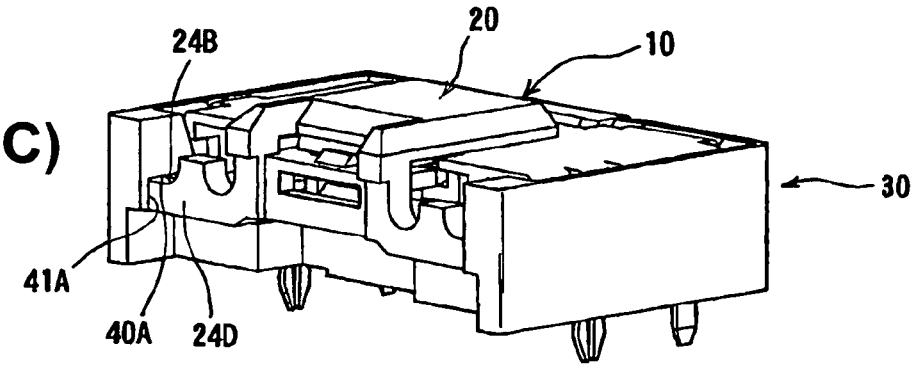

In the embodiment, the circuit board connector 30 that is attached to a circuit board receives the cable connector 10. As shown in FIG. 4(A), a housing 31 of the connector 30 is arranged on the circuit board (not shown) on a lower surface of the bottom wall thereof. Further, two sidewalls 33 and a front wall 34 vertically stands from the bottom wall of the housing 31 to form a peripheral wall 32. Moreover, a receiving recess portion 35 is formed inside of the peripheral wall 32 so as to receive the cable connector 10 to be vertical with respect to a surface of the circuit board.

The cable connector 10 comprises the connector portions 13 and the connecting portion 15 that connects the connector portions 13. Similarly, the circuit board connector 30 comprises two connector portions 36 and the connecting portion 37 to receive the connector portions 13 and the connecting portion 15 of the cable connector 10. The receiving recess portion 35 is formed in the circuit board connector 30. Accordingly, similar to the cable connector 10, the circuit board connector 30 is made to be symmetrical with respect to a vertical surface that is situated between the connector portions 36 and pierces a center of the connecting portion 37.

A terminal 38 is planted on a bottom wall top face of the connector portion 36 of the circuit board connector 30. The terminal 38 is made of a metal sheet bent in a transverse U-shape. Further, the terminal 38 is integrally formed with two contact portions 38A. The contact portions 38A having plate shapes face with each other.

When the circuit board connector 30 is fitted to the cable connector 10, the two contact portions 38A are connected to the terminals 16 of the cable connector 10. Accordingly, the two terminals 16 of the cable connector 10 are connected to the terminal 38 of the circuit board connector 30 in common.

In the embodiment, a connecting leg 38B and an attachment leg 38C penetrate the bottom wall of the housing 31 to protrude downward in the terminal 38. Further, the connecting leg 38B and the attachment leg 38C are connected to a corresponding circuit portion of the circuit board and attached to a respective corresponding attachment hole.

In the embodiment, the common terminal 38 of a particular kind is used, and the terminal 38 may be formed separately to correspond to each of the two terminals 16. Further, the terminal 38 may be provided so that an attachment leg thereof is bent to extend to a side and soldered to a corresponding connection portion that is provided on a surface of the circuit board.

The inner surface of the peripheral wall 32 of the housing 31 of the circuit board connector 30 forms a receiving recess portion 35 so as to fit an outer peripheral surface of the cable connector 10. A cut portion 34A is formed in a correspond portion of the front wall 34 on the peripheral wall 32. The cut portion 34A receives the locking arm 15A of the cable connector 10. Further, the cut portion 34A is not provided with a rear wall and is open. A protrusion 37A is formed in a front side of the connecting portion 37. The protrusion 37A is locked with the locking hook 15A-1 of the locking arm 15A.

Figure 8:
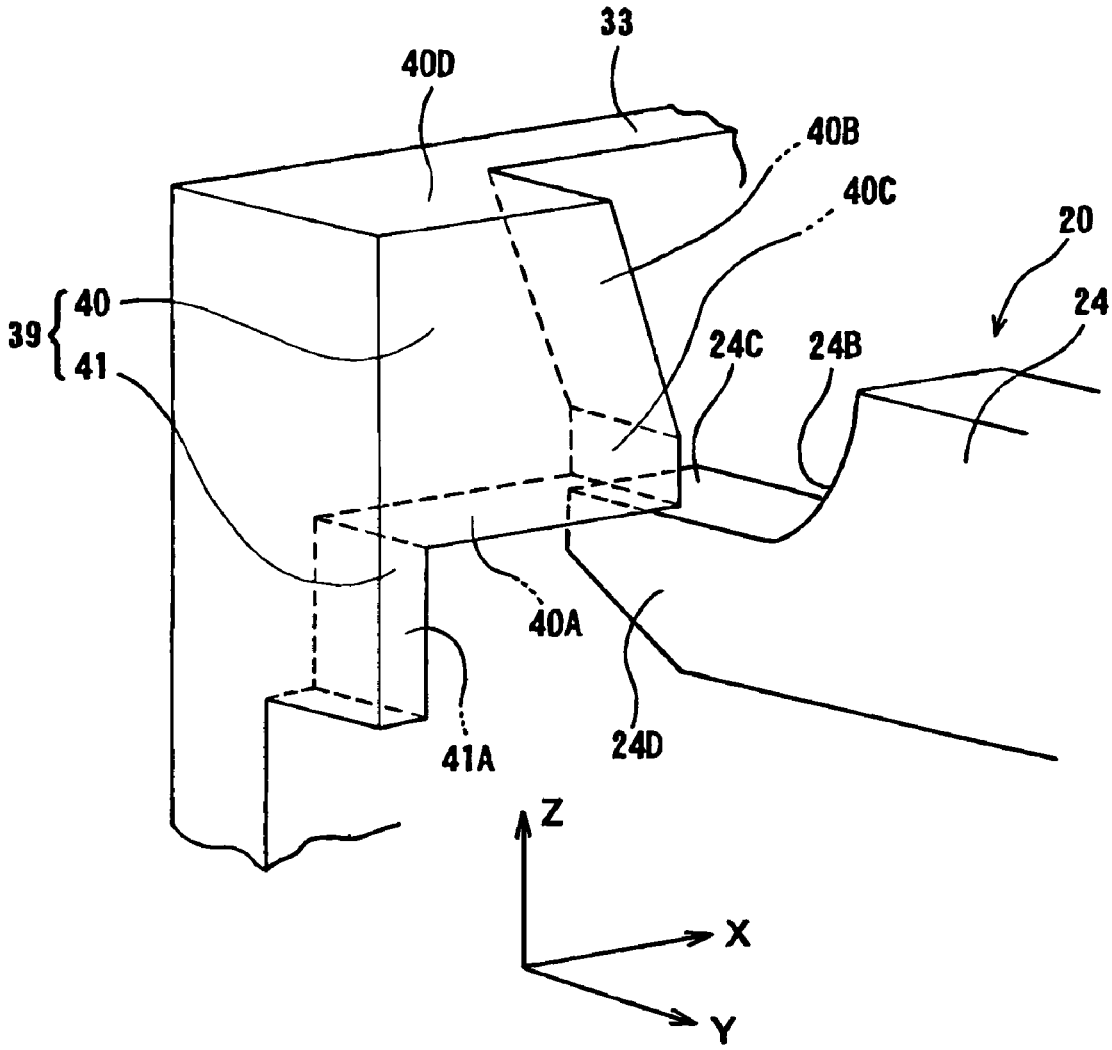
FIG. 8 is a perspective view showing a barrier portion of the circuit board connector and the movable member of the cable connector according to the first embodiment of the present invention.

A barrier portion 39 is provided in an inner surface of the rear edge side of the sidewall 33 (shown in FIGS. 4(A) to 4(C)). The barrier portion 39 having a protruding shape acts on the movable member 20 of the cable connector 10. As shown in FIG. 8, the barrier portion 39 is situated in an upper portion on a rear edge side of an inner surface of the sidewall 33. Further, the barrier portion 39 protrudes frontward (in a direction indicated by an arrow X) in a front-to-back direction and inward (in a direction indicated by an arrow Y) in a width direction in which the sidewalls 33 face each other.

The barrier portion 39 has a blocking portion 40 or an upper portion, and a wall portion 41 or a lower portion. A lower surface of the blocking portion 40 forms an upper regulation surface 40A. The upper regulation surface 40A guides a top face 24C backward and regulates an upward move of the top face 24C on a side edge portion. The side edge portion further protrudes from the recessed curved portion 24B of the overhang portion 24 of the movable member 20 when the cable connector 10 is completely fitted.

In the embodiment, a retreat regulation surface 41A is formed on a front side of the wall portion 41. The retreat regulation surface 41A is adjacent to a rear side 24D of the side edge portion of the movable member 20 and regulates a retreat quantity of the movable member 20 when the movable member 20 receives a retreating operation to move backward.

A slope 40B is provided on a front side of the blocking portion 40 of the barrier portion 39. The slope 40B is provided in a range behind a position in a front-to-back direction of the rear side 24D of the movable member 20 in the advance position (position in X direction). Further, the slope 40B forms a frontward slope from a top edge to a bottom edge. Moreover, a regulation surface 40C is formed on a front side of a lower portion of the slope 40B.

When the cable connector 10 is fitted to the circuit board connector 30 while the terminal 16 is not completely inserted in the cable connector 10 and the movable member 20 is not at the regular advance position, a rear portion of the movable member 20 is adjacent to the slope 40B. Further, the movable member 20 slides on the slope 40B during the fitting process and receives a forward pressing force to reach the regular advance position. That is, due to the fitting of the cable connector 10 and the circuit board connector 30, the terminal 16 is automatically completely inserted. Accordingly, the cable connector 10 is completely fitted to the circuit board connector 30.

When the rear side 24D of the overhang portion 24 of the movable member 20 is positioned behind an upper edge of the slope 40B or on a flat surface 40D behind the upper edge of the slope 40B before the cable connector 10 is completely fitted to the circuit board connector 30, a bottom surface of the overhang portion 24 is adjacent to the flat surface 40D to prevent the cable connector 10 and the circuit board connector 30 from being fitted together. Accordingly, the cable connector 10 and the circuit board connector 30 are prevented from being fitted together while the terminal is not completely inserted.

In this case, a forward pressing force is reapplied to the movable member 20. Then, after confirming that the movable member 20 reaches the regular advance position and the terminal is completely inserted, the cable connector 10 can be fitted to the circuit board connector 30.

When the movable member 20 receives a backward operating force at a complete fitting position of the cable connector 10 and the circuit board connector 30, the movable member 20 retreats so that the rear side 24D thereof is adjacent to the retreat regulation surface 41A while being guided at the upper regulation surface 40A.

When a backward operating force is applied to the movable member 20 and the cable connector 10 and the circuit board connector 30 are not completely fitted together, the rear side 24D of the movable member 20 is adjacent to the slope 40B or the regulation surface 40C to prevent the retreat of the movable member 20. Accordingly, the cable connector 10 and the circuit board connector 30 may be prevented from being fitted together while the cable connector 10 and the circuit board connector 30 are fitted incompletely.

In this case, when the cable connector 10 further advances to be fitted to the circuit board connector 30, the cable connector 10 and the circuit board connector 30 reach the complete fitting position and the movable member 20 may be retreated.

Next, the use of the cable connector 10 and the circuit board connector 30 that are configured as described above will be explained.

First, the terminal 16 with the cable C is attached to the housing 11 of the cable connector 10. The method to crimp the cable C to the terminal 16 for wiring is publicly known and not explained. The cable C is crimped to the terminal 16. The terminal 16 is inserted in the terminal hole 12 of the housing 11 up to a proper position from the rear side to the front side while the movable member 20 is not attached to the housing (FIG. 5(B) shows a state in which the movable member 20 is attached).

In the next step, the movable member 20 is attached to the housing 11. The upper plate portion 22 and the lower plate portion 23 of the movable member 20 slide on the upper and lower surfaces of the top wall 15C of the connecting portion 15 of the housing 11 to advance. At this time, the abutting arm 23B of the lower plate portion 23 advances along the lower surface of the top wall 15C. Further, the thrust arm portions 25A and 25B enter inside of the respective corresponding terminal hole 12.

Each of the thrust arm portions 25A and 25B has a pressing surface on the distal portion thereof. The pressing surface pushes a rear edge of the terminal 16 frontward and the terminal 16 advances. The locking portion 16D of the terminal 16 is stored inside of the locking hole 14B beyond the bottom wall 13B while elastically deforming a part of the bottom wall 13B downward. Then, the bottom wall 13B is restored to prevent the locking portion 16D from retreating or the terminal 16 from coming off. Accordingly, the terminal 16 is held at the regular position to be completely inserted.

The terminal 16 is pushed to the regular position, so that the movable member 20 is situated at the regular advance position. The protrusion 23A functions as a position display portion of the movable member 20. The protrusion 23A is locked in the confirmation portion 15C-1 of the top wall 15C of the housing 11 in the advance position. Accordingly, the protrusion 23A can be visually confirmed from above. In other words, it is possible to visually confirm that the protrusion 23A is situated inside of the confirmation portion 15C-1 and the terminal 16 is situated at the regular position.

When the movable member 20 does not move enough and reach the advanced position, the terminal is not completely inserted. If an incomplete insertion of the terminal is noticed, the movable member 20 can be pushed further to be in the advance position; thereby completely inserting the terminal. However, an incomplete insertion of the terminal can be left unnoticed.

In the embodiment, even when an incomplete insertion of the terminal is left unnoticed, the cable connector 10 may be fitted to the circuit board connector 30 or the mating connector. Accordingly, the connector assembly of the cable connector 10 and the circuit board connector 30 is obtained.

Figure 6:
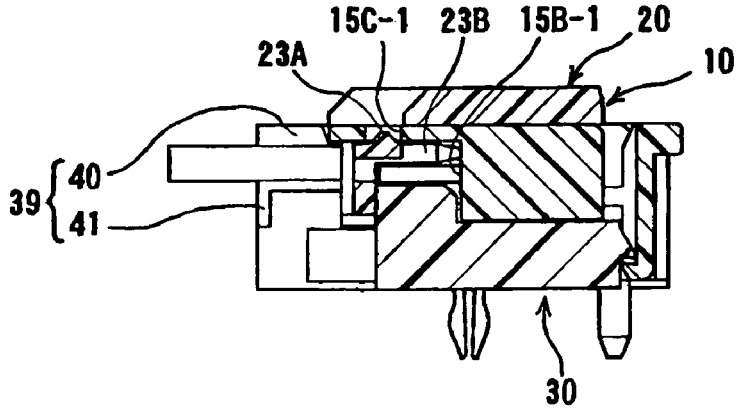
Figure 6:
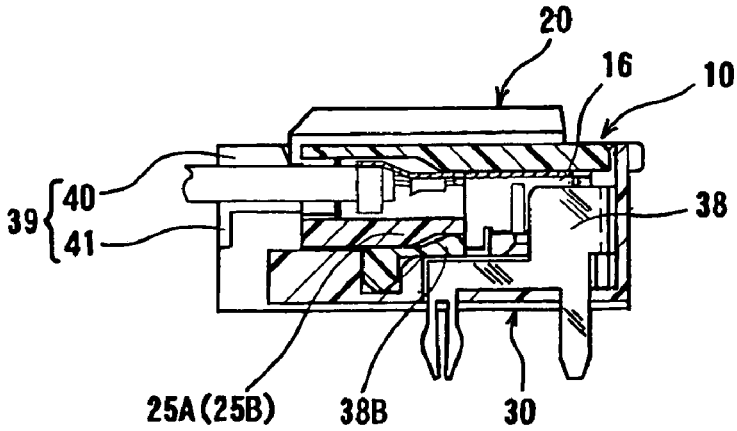
Figure 6:
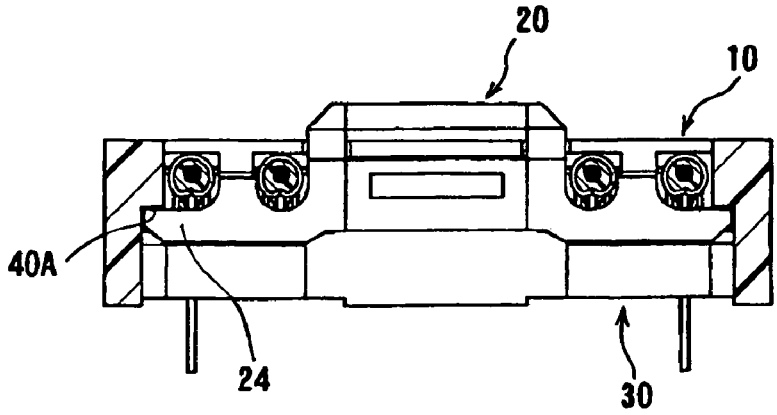

When the movable member 20 of the cable connector 10 reaches the regular advance position and the terminal 16 is completely inserted, the cable connector 10 is stored in the receiving recess portion 35 of the circuit board connector 30 without any difficulty to be completely fitted together (as shown in FIGS. 6(A) to 6(C)). The terminals 16 and 38 are normally electrically connected, and the locking hook 15A-1 of the locking arm 15A of the cable connector 10 is locked to the locking hook 37A of the circuit board connector 30; thereby preventing a coming off.

Figure 7:
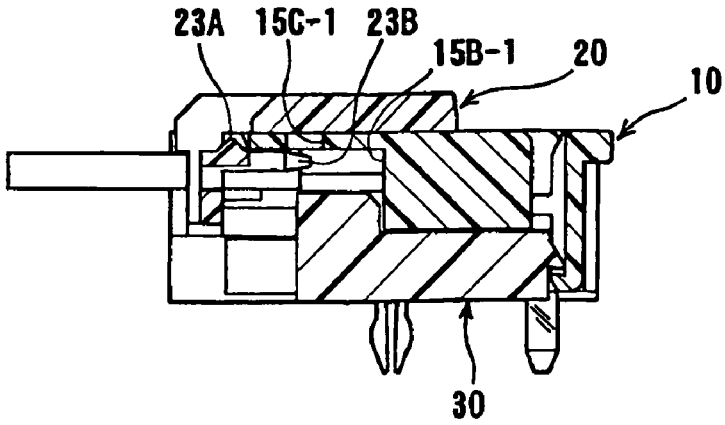
Figure 7:
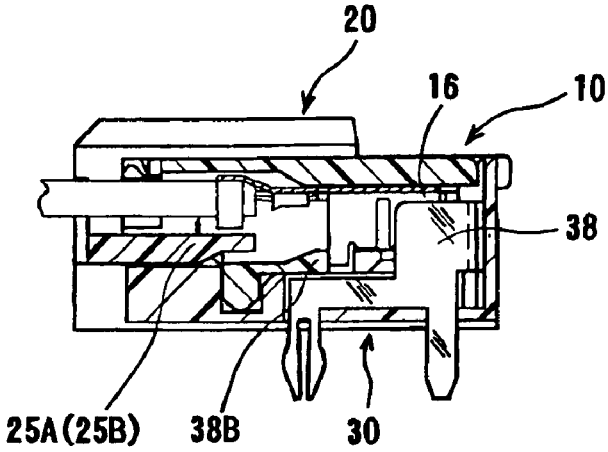
Figure 7:
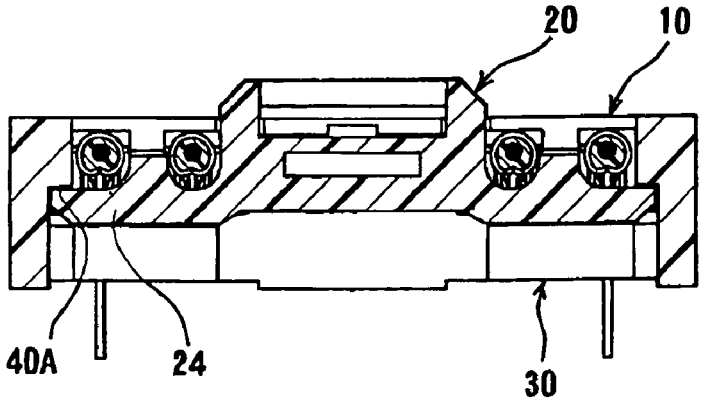

When an operating force is applied to the movable member 20 to retreat from the advance position, the movable member 20 is guided by the upper regulation surface 40A or the lower surface of the blocking portion 40 of the barrier portion 39 of the circuit board connector 30 and retreats so that the rear side 24D of the movable member 20 is adjacent to the retreat regulation surface 41A (shown in FIGS. 7(A) to 7(C)).

The movable member 20 is regulated to move upward in the upper regulation surface 40A at the retreat position; thereby preventing a separation of the cable connector 10 and the circuit board connector 30. More specifically, the upper regulation surface 40A is situated at a rear portion of the connector assembly. Accordingly, even if the cable is loaded in a direction in which the cable connector 10 and the circuit board connector 30 are separated, an upward move in the upper regulation surface 40A is regulated to have a locking mechanism.

At the same time, the contact portion of the terminal is not adversely affected. Further, at the retreat position, the protrusion 23A of the lower plate portion 23 of the movable member 20 comes off from the confirmation portion 15C-1 having a window shape to move backward. Further, the upper plate portion 22 blocks the top wall 15C, which allows to visually confirmation that the movable member 20 is completely fitted at the retreat position.

When the rear side 24D of the movable member 20 is adjacent to the regulation surface 40C to prevent the movable member 20 from retreating even if the movable member 20 receives an operating force to retreat from the advance position, the protrusion 23A of the lower plate portion 23 of the movable member 20 does not come off from the confirmation portion 15C-1 having a window shape. In this case, the top wall 15C is exposed. Accordingly, it may be visually confirmed that the movable member 20 is not situated at the retreat position and is not completely fitted.

When the cable connector 10 is fitted to the circuit board connector 30, the cable connector 10 and the circuit board connector 30 are fitted together even if the movable member 20 of the cable connector 10 does not reach the regular advance position and the terminal 16 is not completely inserted.

In this case, the movable member 20 does not reach the regular advance position. As described above, the movable member 20 is pushed forward by the pressing slope 40B and advances automatically due to the continuation of the fitting of the cable connector 10 and the circuit board connector 30. As a result, the terminal 16 is completely inserted.

In the embodiment, the pressing slope 40B is formed in the blocking portion 40 of the barrier portion 39 of the circuit board connector 30. The rear side 24D of the overhang portion 24 of the movable member 20 is positioned to be behind the upper edge of the slope 40B before the cable connector 10 and the circuit board connector 30 are fitted. Accordingly, the lower surface of the overhang portion 24 of the movable member 20 is adjacent to the flat surface 40D of the housing. When the fitting is inhibited, a forward pressing force is simply reapplied to the movable member 20, so that the movable member 20 reaches the regular advance position. Accordingly, the circuit board connector 30 may be fitted while completely inserting the terminal 16.

A rear side of the movable member 20, for example, the rear wall portion 21 and the locking arm 15A, are taken between two fingers to lift the cable connector 10 to pull out the cable connector 10 from the circuit board connector 30. The rear side of the rear wall portion 21 of the movable member 20 forms the pressed portion and receives a forward force at the pressed portion to move from the retreat position to the advance position, thereby coming off from a regulation of the upper regulation surface 40A.

Further, the locking arm 15A receives a backward force at the operating portion 15A-3 and is displaced as a lever at the fulcrum portion 15D. The locking hook 15A-1 moves forward to come off from the protrusion 37A of the circuit board connector 30, thereby releasing the lock there. Accordingly, the cable connector 10 can be pulled out by one operation with ease.

Second Embodiment

A second embodiment of the present invention will be explained next. Different from the first embodiment, in the second embodiment, it is possible to ensure that the movable member 20 is guided with ease when moving.

In the second embodiment, the cable connector 10 and the circuit board connector 30 are basically configured similar to those in the first embodiment, except the point relating to guiding as described above. Accordingly, components in the second embodiment similar to those in the first embodiment are designated with the same reference numerals, and explanations thereof are omitted. Further, in the second embodiment, a use of the cable connector 10 and the circuit board connector 30 is similar to that in the first embodiment, and an explanation thereof is omitted. Hereinafter, mainly a difference from the first embodiment will be explained.

Figure 9:
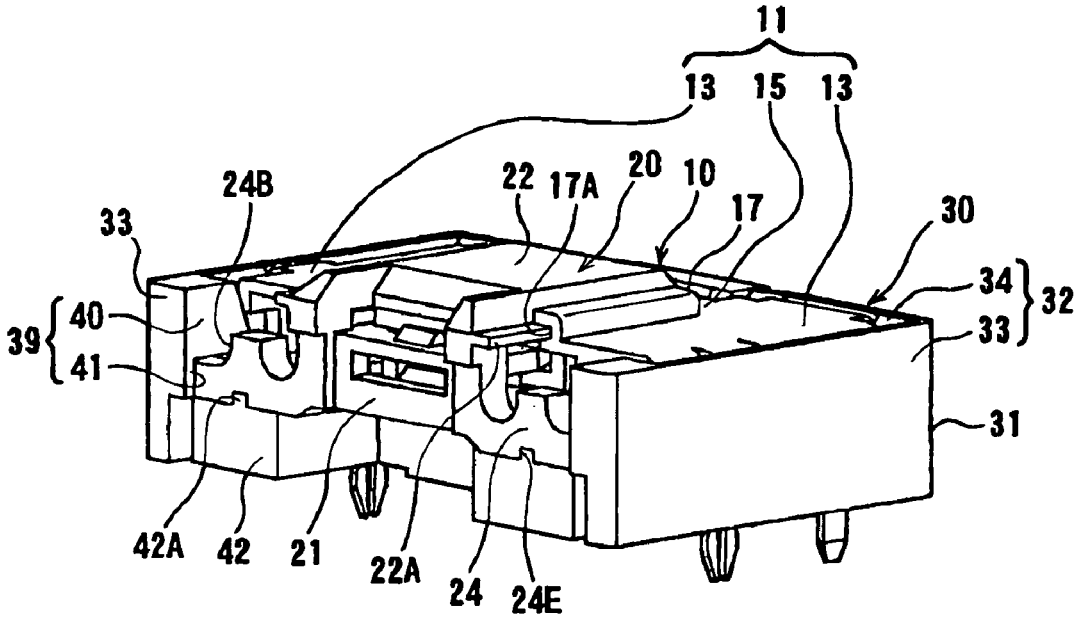
Figure 9:
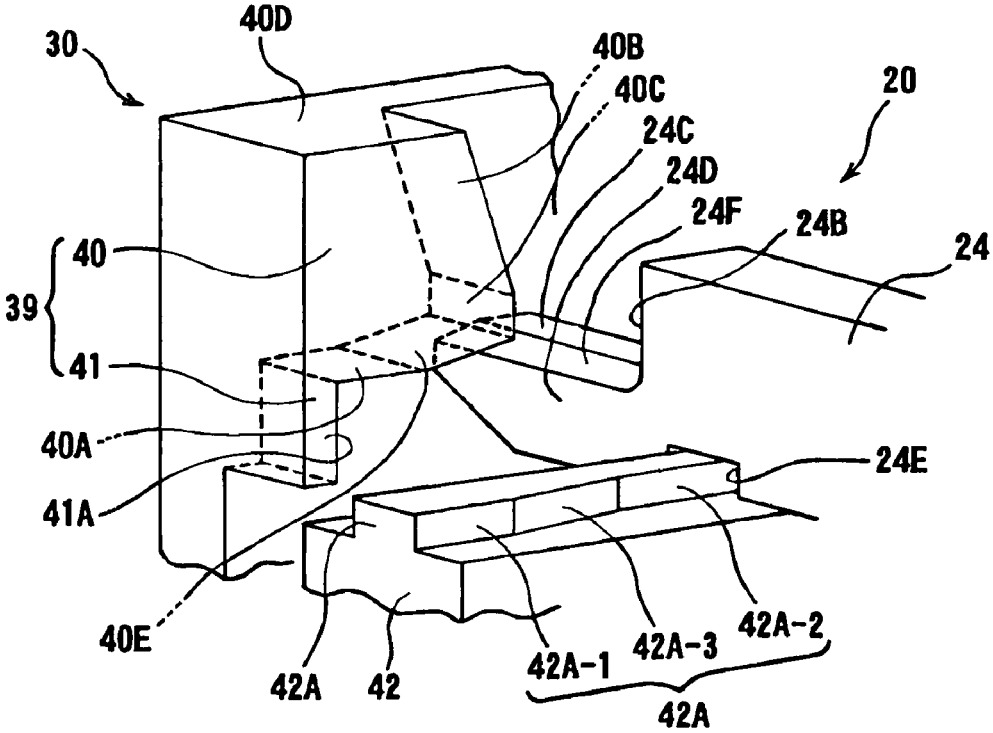

FIGS. 9(A) and 9(B) are perspective views showing a connector assembly according to the second embodiment of the present invention. More specifically, FIG. 9(A) is a perspective view showing the connector assembly, and FIG. 9(B) is an enlarged perspective view showing the cable connector 10 and the circuit board connector 30 of the connector assembly. In FIG. 9(A), the cable is omitted for the sake of explanation.

In the embodiment, a pair of hooked portions 17 is formed at a transition portion between the connector portions 13 and the connecting portion 15 on the top face of the housing 11 of the cable connector 10. The hooked portion 17 has a hook-like cross-section on a surface perpendicular to a front-to-back direction of the cable connector 10.

The hooked portions 17 have hook-like cross-sections bent in a direction in which the hooked portions 17 face to be closer to each other. Further, the hook-like cross-section of the hooked portions 17 extends forward from a rear edge of the housing 11 as shown in FIG. 9(A).

In the embodiment, a rear edge portion of a guide groove 17A is positioned at the rear edge of the housing 11 to open backward, and the rear edge portion of the guide groove 17A can be visually confirmed from the rear side with ease when the movable member 20 is attached to the housing 11. Accordingly, the movable member 20 can be attached with ease.

The guide groove 17A is situated on an insertion side of a guide protruding bar portion 22A that is provided in the movable member 20 to correspond. The top face of the housing 11 and an inner surface of the hooked portion 17 form a transverse U-character shape portion. The transverse U-character shape portion is formed as the guide groove 17A to guide a front-to-back move of the movable member 20 to conform to the guide protruding bar portion 22A of the movable member 20. The guide protruding bar portion 22A will be explained below in more detail.

In the embodiment, the guide protruding bar portion 22A is formed on each side surface of the upper plate portion 22 of the movable member 20. The guide protruding bar portion 22A protrudes outward and extends in the front-to-back direction in the whole area in the connector width direction (right-to-left direction in FIG. 9(A)). As shown in FIG. 9(A), the guide protruding bar portion 22A conforms to the guide groove 17A of the housing 11 and is guided by the guide groove 17A when the movable member 20 moves.

As described above, in the embodiment, the guide protruding bar portion 22A is provided in the movable member 20, and the guide groove 17A that conforms to the guide protruding bar portion 22A is provided in the housing 11. Accordingly, the movable member 20 may be moved forward and backward smoothly with respect to the housing 11 when moving in a front-to-back direction thereof while the guide groove 17A regulates the movement of the guide protruding bar portion 22A in a direction perpendicular to the front-to-back direction or to the left, right, top, and bottom directions.

In the embodiment, the front edge of the upper plate portion 22 of the movable member 20 is pushed backward with a finger from a front side to pull out, so that the movable member 20 can be separated from the housing 11. When the upper plate portion 22 of the movable member 20 is pushed, a pulling-up force to pull up the front edge of the upper plate portion 22 upward by the finger tends to act.

Here, if an upward movement of the upper plate portion 22 is not regulated, a front side of the upper plate portion 22 is lifted taking the connecting portion with the rear wall portion 21 as a pivot and the movable member 20 can be broken in the connecting portion and damaged.

In the embodiment, even if an upward force is applied to the upper plate portion 22, the upward movement of the guide protruding bar portion 22A of the movable member 20 is regulated by the inner surface of the guide groove 17A of the housing 11 over a long range in the front-to-back direction. Accordingly, the front side of the upper plate portion 22 is not lifted, thereby preventing the movable member 20 from being damaged.

In the embodiment, the guide protruding bar portion 22A is provided in the movable member 20 and the guide grove 17A is provided in the housing 11. Alternatively, the guide groove 17A may be provided in the movable member 20 and the guide protruding bar portion 22A may be provided in the housing 11.

In the embodiment, in the housing 31 of the circuit board connector 30, a base part 42 having a rectangular shape extends backward from the rear edges of the connector portions of the circuit board connector 30 to substantially the same position as the rear side of the barrier portion 39. A guide protruding bar portion 42A is formed to extend in the front-to-back direction in a middle portion of a connector width direction on the top face of the base part 42. The guide protruding bar portion 42A protrudes upward in which a movement of the movable member 20 is guided after the cable connector 10 and the circuit board connector 30 are fitted.

In the embodiment, a guide groove 24E is formed to extend in the front-to-back direction on a lower surface of the overhang portion 24 of the movable member 20. The guide groove 24E conforms to the guide protruding bar portion 42A of the circuit board connector 30.

As described above, in the embodiment, the guide protruding bar portion 42 is provided in the circuit board connector 30 and the guide groove 24E is provided in the movable member 20. Accordingly, when the movable member 20 is moved in the front-to-back direction while the cable connector 10 and the circuit board connector 30 are fitted together, the movable member 20 is guided in the guide groove 24E by the guide protruding bar portion 42. As a result, the movable member 20 can move smoothly.

FIG. 9(B) is a perspective view showing a relationship between the guide protruding bar portion 42A of the circuit board connector 30 and the guide groove 24E of the movable member 20 of the cable connector 10, and a relationship between the barrier portion 39 of the circuit board connector 30 and the movable member 20 shown in FIG. 9(A).

The guide protruding bar portion 42A includes a wide width portion 42A-1, a narrow width portion 42A-2, and a transition portion 42A-3. The wide width portion 42A-1 is provided on a rear edge side. The narrow width portion 42A-2 is provided on a front edge side and has a width that is narrower than that of the wide width portion 42A-1. The transition portion 42A-3 is provided between the wide width portion 42A-1 and the narrow width portion 42A-2.

In the embodiment, the transition portion 42A-3 connects the wide width portion 42A-1 and the narrow width portion 42A-2 and has a width that is narrower forward. A width of the guide groove 24E of the movable member 20 is a size that conforms to the wide width portion 42A-1 or substantially the same as that of the wide width portion 42A-1 over the range of the entire length thereof. Further, a length of the guide groove 24E of the movable member 20 in the front-to-back direction of the guide portion 24E is substantially the same as that of the wide width portion 42A-1 in the same direction.

In the embodiment, the guide protruding bar portion 42A is formed so as to have a plurality of portions having variety of widths in the front-to-back direction. Alternatively, the guide protruding bar portion 42A may be formed with a specific width that is the same as that of the guide groove 24E over the whole area of the front-to-back direction.

The guide protruding bar portion 42A and the guide groove 24E are formed with the shape and the size described above. Accordingly, the movable member 20 can move more smoothly. Further, the movable member 20 is held securely at the retreat position.

That is, when the movable member 20 is retreated after the fitting of the cable connector 10 and the circuit board connector 30, a space is formed between the guide groove 24E and the narrow width portion 42A-2 and between the guide groove 24E and the transition portion 42A-3 in the width direction while the guide groove 24E of the movable member 20 passes through the range of the narrow width portion 42A-2 and the transition portion 42A-3. Accordingly, no resistance force is generated when the movable member 20 is retreated, and the movable member 20 may be retreated with ease.

When the guide groove 24E reaches the range of the wide width portion 42A-1, the guide groove 24E and the wide width portion 42A-1 contact each other. Then, the movable member 20 slides with respect to the wide width portion 42A-1. As a result, the guide groove 24E and the wide width portion 42A-1 closely contact each other and the movable member 20 is securely held at the retreat position when the movable member 20 completely retreats.

When the movable member 20 at the rear position is advanced to release the fitting of the cable connector 10 and the circuit board connector 30, the movable member 20 smoothly advances without generating any resistance force after the guide groove 24E is moved outward from the range of the wide width portion 42A-1.

As shown in FIG. 9(B), a slope 24F is formed in the overhang portion 24 of the movable member 20. The slope 24F is inclined from the top face 24C toward the rear side 24D of the side edge portion. Further, a slope 40E is formed in the blocking portion 40 of the circuit board connector 30. The slope 40E is inclined from the regulation surface 40C toward the upper regulation surface 40A at the angle that is substantially the same as that of the slope 24F.

In the embodiment, the slope 24F and the slope 40E function as guide surfaces when the movable member 20 is retreated. Accordingly, the movable member 20 is guided by the slope 24F and the slope 40E to be below the blocking portion 40 when the movable member 20 is retreated, and the movable member 20 is retreated smoothly.

Further, the fitting of the cable connector 10 to the circuit board connector 30 further progresses since the movable member 20 is guided to be below the blocking portion 40. The movable member 20 retreats until the rear side 24D of the movable member 20 is adjacent to the retreat regulation surface 41A. The top face 24C of the side edge portion of the overhang portion 24 of the movable member 20 is situated below the blocking portion 40A at the retreat position. Accordingly, an upward move of the movable member 20 is regulated in the upper regulation surface 40A; thereby preventing the cable connector 10 and the circuit board connector 30 from being separated.

In the embodiment, the slope 24F is formed in the movable member 20 and the slope 40E is formed in the circuit board connector 30. Alternatively, only one of the slope 24F and the slope 40E may be provided. Even in the case in which only one of the slopes is provided, the movable member 20 is guided to be below the blocking portion 40 by the slope when the movable member 20 retreats. Accordingly, the movable member 20 is smoothly retreated.

Third Embodiment

A third embodiment of the present invention will be explained. Different from the second embodiment, in the third embodiment, the movable member 20 advances after the fitting of the cable connector 10 and the circuit board connector 30. In the second embodiment, the movable member 20 is retreated after the fitting of the cable connector 10 and the circuit board connector 30.

In the third embodiment, the cable connector 10 and the circuit board connector 30 have configurations similar to those in the second embodiment. Accordingly, similar portions are assigned with the same reference numerals, and explanations thereof are omitted. Only differences from the second embodiment are focused and will be explained.

Figure 10:
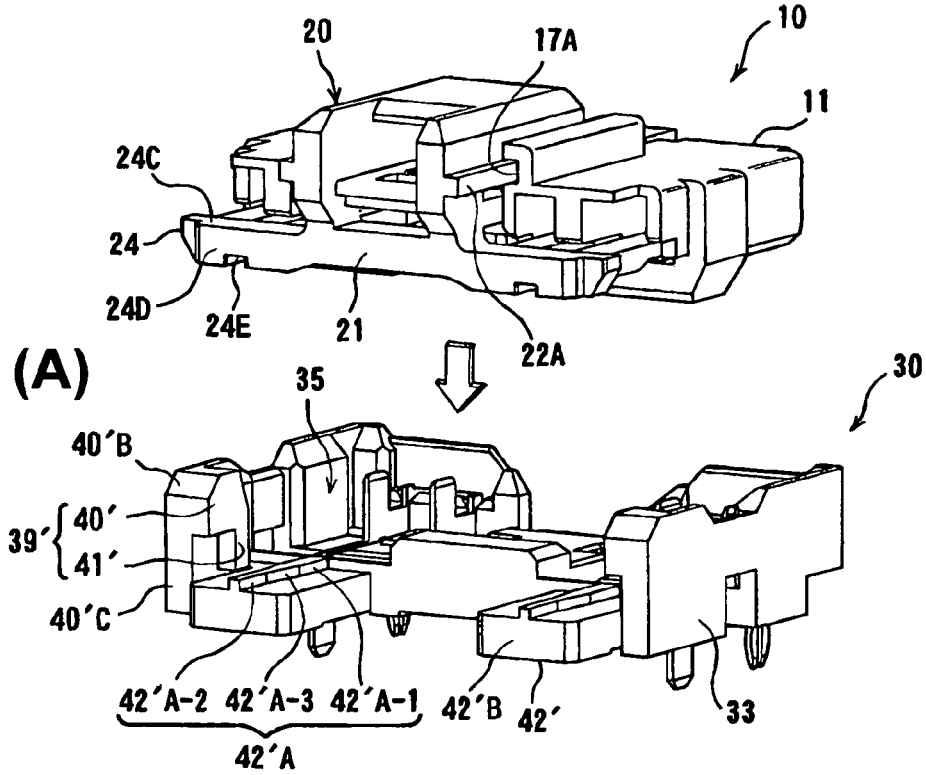
Figure 10:
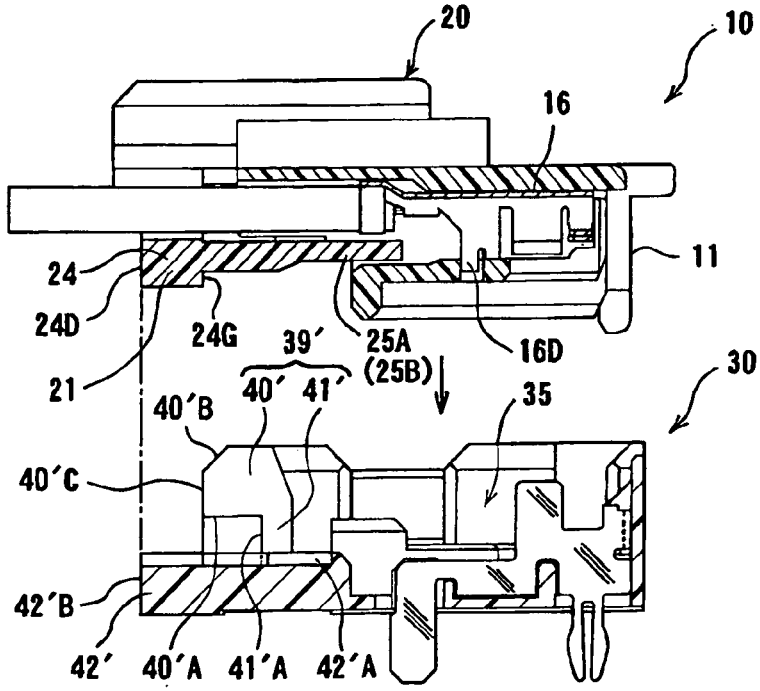
Figure 11:
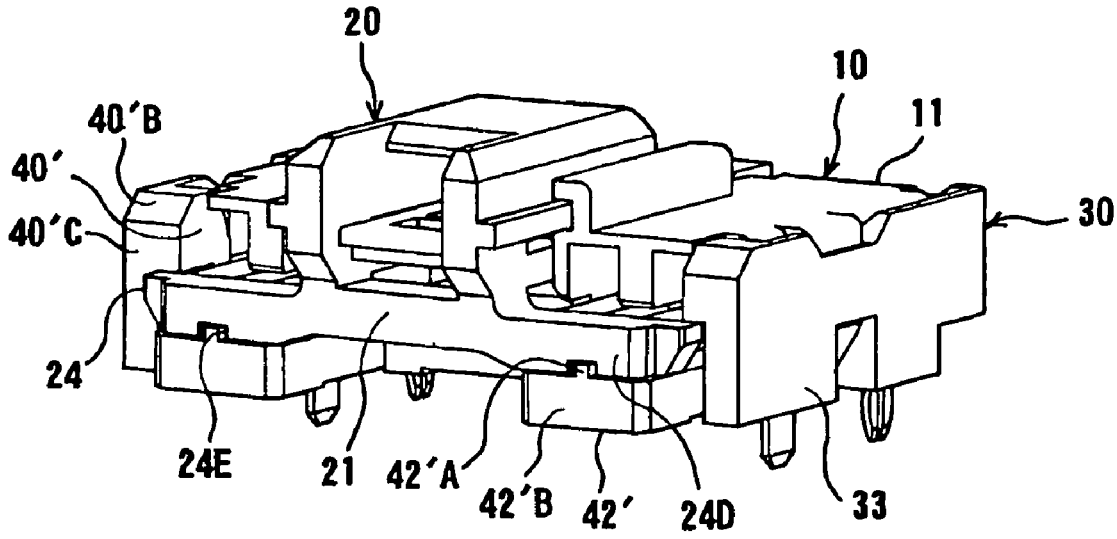
Figure 11:
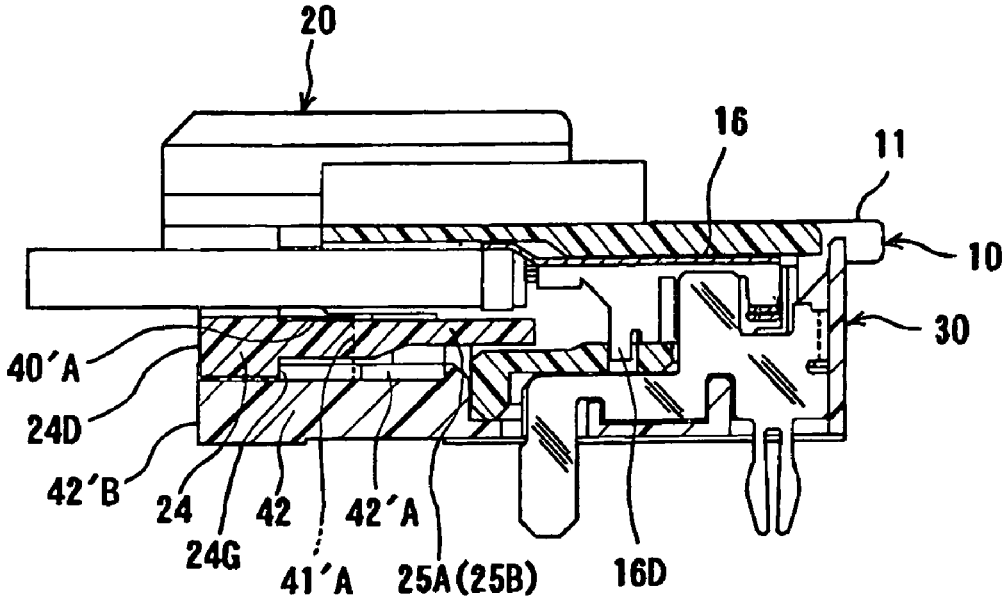
Figure 12:
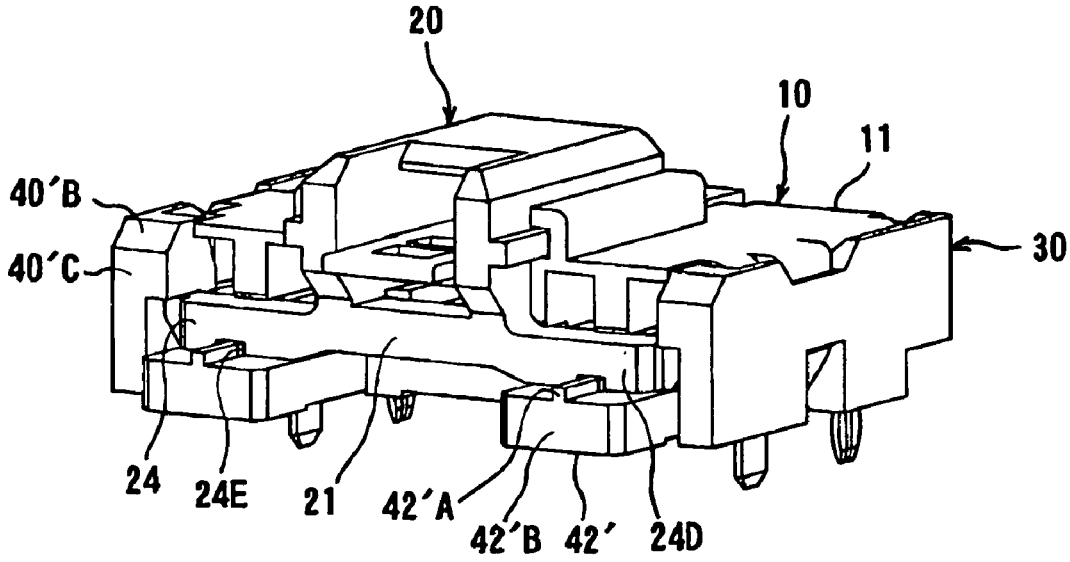
Figure 12:
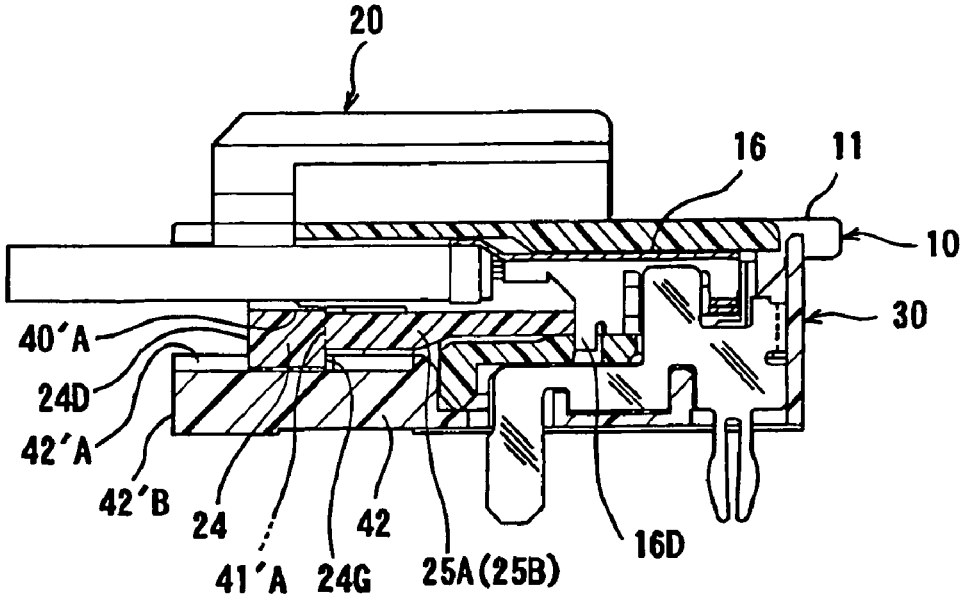

FIGS. 10(A)-10(C) to 12(A)-12(C) are views showing the cable connector and the circuit board connector or the mating connector according to the embodiment. FIGS. 10(A) to 10(C) show a state before the fitting of the cable connector 10 and the circuit board connector 30. FIGS. 11(A) to 11(C) show a state in which the cable connector 10 and the circuit board connector 30 are fitted together and the movable member 20 is situated at the retreat position. FIGS. 12(A) to 12(C) show a state in which the cable connector 10 and the circuit board connector 30 are fitted together and the movable member 20 is situated at the advance position.

Further, FIGS. 10(A), 11(A), and 12(A) are perspective views. FIGS. 10(B), 11(B), and 12(B) are sectional views at a position of the terminal of the circuit board connector 30. The cable is not shown in FIGS. 10(A), 11(A), and 12(A) so as to clearly show the configuration of the connector assembly.

In the embodiment, a barrier portion 39' of the circuit board connector 30 includes a blocking portion 40' and a wall portion 41'. The blocking portion 40' is a top portion and the wall portion 41' is a bottom portion. As shown in FIG. 10(B), the wall portion 41' is formed in a position that is closer to a front portion below the blocking portion 40'.

In the embodiment, a lower surface of the blocking portion 40' forms an upper regulation surface 40'A. The upper regulation surface 40'A guides the top face 24C of the side edge portion in the overhang portion 24 of the movable member 20 forward after the cable connector 10 is completely fitted. Further, the upper regulation surface 40'A regulates an upward movement of the top face 24C of the side edge portion in the overhang portion 24 of the movable member 20.

In the embodiment, a rear side of the wall portion 41' forms an advance regulation surface 41'A. The advance regulation surface 41'A is adjacent to a front side 24G of the side edge portion of the movable member 20 and regulates an advance amount of the movable member 20 when the movable member 20 receives an advance operation to move forward.

A slope 40'B is provided on an upper rear side of the blocking portion 40' of the barrier portion 39'. The slope 40'B is situated in front of the front side 24G of the movable member 20 that is situated at the retreat position. The slope 40'B has a backward slope from a top edge to a lower edge thereof. Further, a regulation surface 40'C is formed on a rear side below the slope 40'B.

A base part 42' of the circuit board connector 30 is formed to extend to a position behind the regulation surface 40°C of the blocking portion 40'. A guide protruding bar portion 42'A is formed in a center portion of the connector width direction of a top face of the base part 42' to extend in a front-to-back direction. The guide protruding bar portion 42'A protrudes upward to guide a movement of the movable member 20 after the fitting of the cable connector 10 and the circuit board connector 30.

In the embodiment, the guide protruding bar portion 42'A includes a wide width portion 42'A-1, a narrow width portion 42'A-2, and a transition portion 42'A-3. The wide width portion 42'A-1 is provided on the front edge side of the guide protruding bar portion 42'A. The narrow width portion 42'A-2 is provided on the rear edge side of the guide protruding bar portion 42'A and has a width that is narrower than that of the wide width portion 42A'-1. The transition portion 42'A-3 is provided between the wide width portion 42'A-1 and the narrow width portion 42'A-2. The transition portion 42'A-3 connects the wide width portion 42'A-1 and the narrow width portion 42'A-2 and has a width that becomes wider toward the front portion thereof.

In the embodiment, a width of the guide groove 24E of the movable member 20 is formed to be substantially the same as that of the wide width portion 42'A-1 of the guide protruding bar portion 42'A over the full length. Further, the size of the guide groove 24E in the front-to-back direction is substantially the same as that of the wide width portion 42'A-1 in the direction.

In the embodiment, the guide protruding bar portion 42'A is formed to have a plurality of portions having various widths in the front-to-back direction. Alternatively, the guide protruding bar portion 42'A may be formed to have a specific width that is equal to the width of the guide groove in the whole area of the front-to-back direction thereof.

Next, the use of the cable connector 10 and the circuit board connector 30 that are configured as described above will be explained.

First, the terminal (not shown) having the cable is attached to the housing 11 in the same method in the first embodiment. That is, the terminal to which the cable is crimped is inserted in an appropriate position of the terminal hole 12 of the housing 11 from a rear side to a front side before the movable member 20 is attached to the housing 11.

Next, the movable member 20 is attached to the housing 11 from behind. In the embodiment, similar to the second embodiment, the guide protruding bar portion 22A is provided in the movable member 20, and the guide groove 17A is provided in the housing 11. The guide groove 17A conforms to the guide protruding bar portion 22A. Accordingly, when the movable member 20 is attached, the guide protruding bar portion 22A is guided forward by the guide groove 17A. Accordingly, the movable member 20 may be advanced smoothly.

In the embodiment, the movable member 20 does not move to the front when the movable member 20 is attached to the housing 11. More specifically, as shown in FIG. 10(B), the movable member 20 advances so that the front side 24G of the rear wall portion 21 of the movable member 20 is situated behind the rear side of the blocking portion 40' of the circuit board connector 30 or the regulation surface 40'C when the housing 11 of the cable connector 10 is arranged immediately above the receiving recess portion 35 of the circuit board connector 30.

As shown in FIG. 10(B), the front side 24G is positioned slightly behind the regulation surface 40'C. In the embodiment, the position of the movable member 20 shown in FIGS. 10(A) and 10(B) is referred to as a "retreat position".

In the embodiment, as indicated by a phantom line in FIG. 10(B), a position of a rear side 42' B of the base part 42' of the circuit board connector 30 and a position of the rear side 24D of the overhang portion 24 of the movable member 20 are matched in the front-to-back direction of the connector.

As indicated by an arrow in FIGS. 10(A) and 10(B), the cable connector 10 is basically stored in the receiving recess portion 35 from above the circuit board connector 30 in the similar manner as in the first embodiment and is fitted to the circuit board connector 30. Accordingly, the connector assembly that is shown in FIGS. 11(A) and 11(B) can be obtained.

In the embodiment, the front side 24G of the rear wall portion 21 of the movable member 20 at the retreat position is positioned behind the regulation surface 40'C of the blocking portion 40' of the circuit board connector 30. Accordingly, the rear wall portion 21 passes thorough behind the blocking portion 40' upon fitting of the cable connector 10 and the circuit board connector 30.

As shown in FIG. 11(A), after the cable connector 10 and the circuit board connector 30 are completely fitted together, the narrow width portion 42'A-2 of the guide protruding bar portion 42'A is stored inside of the guide groove 24E of the movable member 20.

As shown in FIG. 11(B), there is a space between the distal end face of the thrust arm portions 25A and 25B of the movable member 20 and the rear edge of the locking portion 16D of the terminal 16 in the front-to-back direction. That is, the distal end face of the thrust arm portions 25A and 25B of the movable member 20 and the rear edge of the locking portion 16D of the terminal 16 do not contact each other. Accordingly, when the movable member 20 is at the retreat position, the terminal 16 is not supported by the thrust arm portions 25A and 25B.

It is possible that the movable member 20 is positioned forward of the retreat position before the fitting of the cable connector 10 and the circuit board connector 30. In this case, when the front side 24G of the overhang portion 24 of the movable member 20 is situated within a range of the slope 40'B of the circuit board connector 30 in the front-to-back direction, the movable member 20 can automatically move to the retreat position by the normal fitting operation.

That is, the front side 24G of the overhang portion 24 is adjacent to the slope 40'B and the movable member 20 receives a backward pressing force while sliding on the slope 40'B to move to a retreat position as the fitting progresses. Accordingly, the cable connector 10 and the circuit board connector 30 can be completely fitted together.

When the front side 24G of the overhang portion 24 is positioned forward of the slope 40'B of the circuit board connector 30, the fitting operation of the cable connector 10 and the circuit board connector 30 can be done after the movable member 20 is moved to the retreat position.

After the cable connector 10 and the circuit board connector 30 are completely fitted together, as shown in FIGS. 12(A) and 12(B), the movable member 20 moves forward. When the movable member 20 receives a forward operating force, the movable member 20 advances until the front side 24G of the overhang portion 24 becomes adjacent to the advance regulation surface 41'A (indicated by a phantom line in FIG. 12(B)) while guided by the upper regulation surface 40'A.

If a forward operating force is applied toward the movable member 20 when the cable connector 10 and the circuit board connector 30 are not completely fitted together, the front side 24G of the movable member 20 becomes adjacent to the slope 40'B or the regulation surface 40'C to prevent an advancement of the movable member 20. Accordingly, it can be prevented that the cable connector 10 and the circuit board connector 30 are fitted together when the cable connector 10 and the circuit board connector 30 are not completely fitted together. In this case, if the fitting of the cable connector 10 and the circuit board connector 30 is progressed, the cable connector 10 and the circuit board connector 30 can be completely fitted together. Accordingly, the movable member 20 can be progressed.

As shown in FIG. 12(B), the distal end face of the thrust arm portions 25A and 25B of the movable member 20 is adjacent to the rear edge of the locking portion 16D of the terminal 16 to support the terminal 16 in a front-to-back direction in a position in which a forward moving of the movable member 20 is completed or the advance position.

As described above, in the embodiment, the terminal 16 can be supported at the distal end face of the thrust arm portions 25A and 25B after the fitting of the cable connector 10 and the circuit board connector 30, and the terminal 16 is supported when the connector assembly is used. Accordingly, it can be prevented that the terminal 16 comes off backward when the connector assembly is used.

In the embodiment, as described above, the guide protruding bar portion 42'A comprises the narrow width portion 42A'-2, the transition portion 42A'-3, and the wide width portion 42A'-1 from a rear portion to a front portion thereof. Accordingly, the movable member 20 can be smoothly moved. Further, the movable member 20 is securely held in a state in which a forward movement of the movable member 20 is completed.

That is, after the fitting of the cable connector 10 and the circuit board connector 30, a space is formed between the guide groove 24E and the narrow width portion 42'A-2 and between the guide groove 24E and the transition portion 42'A-3 in a width direction while the guide groove 24E of the movable member 20 is passing through a range of the narrow width portion 42'A-2 and the transition portion 42A'-3 when the movable member 20 is advanced. Accordingly, no resistance force is generated when the movable member 20 is advanced. The movable member 20 can be advanced with ease.

When the guide groove 24E reaches a range of the wide width portion 42'A-1, the guide groove 24E and the wide width portion 42'A-1 contact each other and the movable member 20 slides with respect to the wide width portion 42'A-1. As a result, the guide groove 24E and the wide width portion 42'A-1 closely contact each other and the movable member 20 is securely held at the advance position in a state in which a forward movement of the movable member 20 is completed.

When the movable member 20 at the advance position is retreated to release the fitting of the cable connector 10 and the circuit board connector 30, the movable member 20 may be retreated without generating resistance force after the guide groove 24E is moved outside of the range of the wide width portion 42'A-1.

Fourth Embodiment

A fourth embodiment of the present invention will be explained next. Different from the first embodiment, in the fourth embodiment, the movable member 20' is attached to the housing 11' from below the housing 11'. In the first embodiment, the movable member 20 is attached from behind the housing 11.

In the fourth embodiment, the cable connector 10' and the circuit board connector have configurations similar to those in the first embodiment. Accordingly, the same reference numerals are assigned to the similar portions, and explanations thereof are omitted. Only differences from the first embodiment will be explained.

Figure 13:
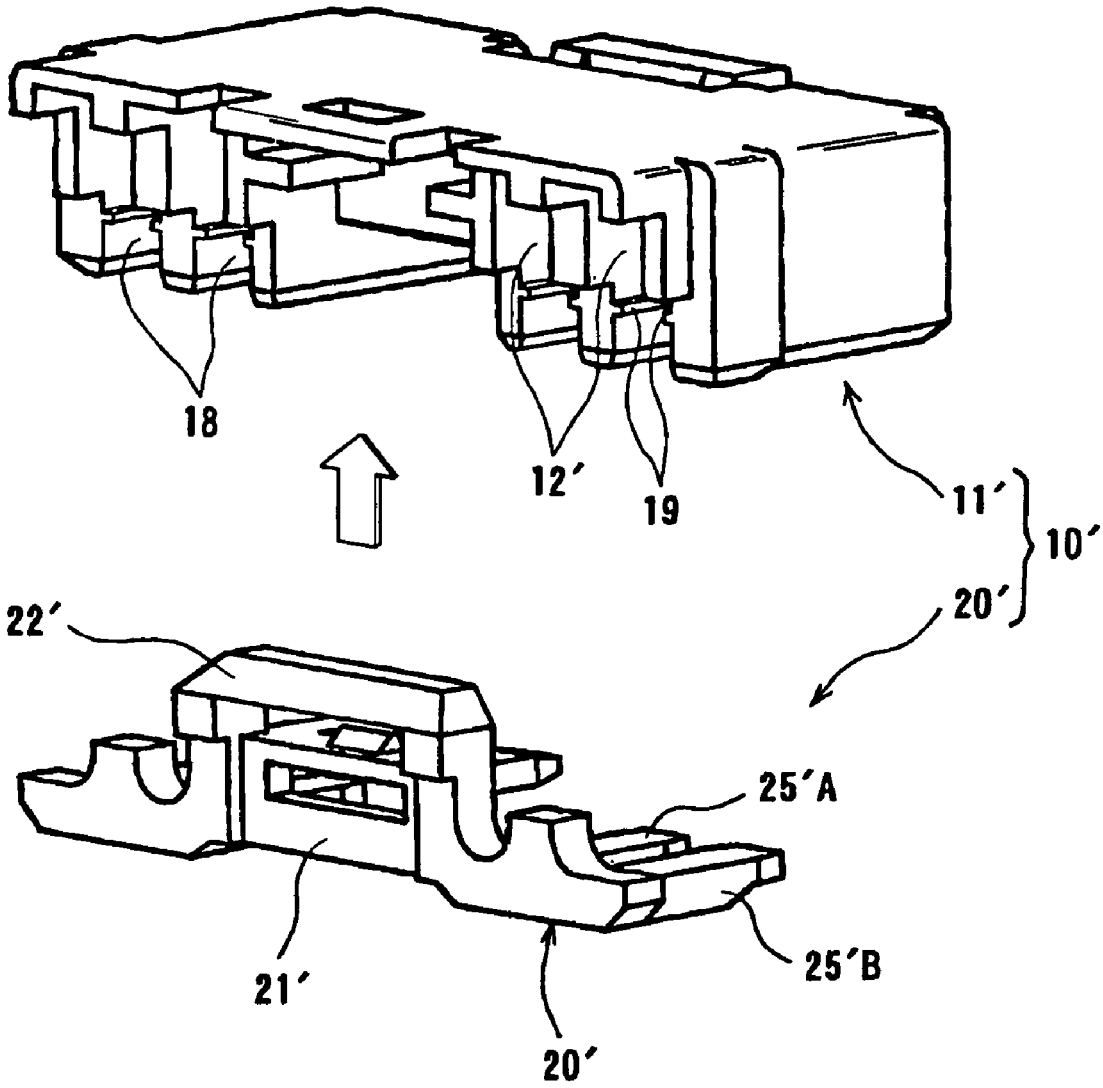
FIG. 13 is a perspective view showing a housing of a cable connector and a movable member in a state before the movable member is attached to the housing according to a fourth embodiment of the present invention.

FIG. 13 is a perspective view showing the housing 11' of the cable connector 10' and the movable member 20' that is attached to the housing 11' in a state in which the movable member 20' is attached to the housing 11'. In FIG. 13, the cable is not shown so as to clearly show a configuration of the housing.

In the embodiment, a terminal hole 12' of the housing 11' is formed through cutting a bottom portion of the terminal hole of the housing 11' and communicating the terminal hole 12' and an external space below the housing 11'. A groove portion 18 is formed below the terminal hole 12' to communicate the terminal 12' and the external space.

As shown in FIG. 13, a protruding portion 19 is formed in an upper portion of the groove portion 18. The protruding portion 19 protrudes from the inner surface of the groove portion 18 to a direction in which the protruding portions 19 face each other to be close to each other in a connector width direction and extends in a front-to-back direction. The protruding portion 19 separates the terminal hole 12' and the groove portion 18.

The upper plate portion that is provided in the movable member 20 in the first embodiment is not provided in the movable member 20'. Instead, an operating portion 22' is provided in an upper portion of a rear wall portion 21'. The operating portion 22' extends in a connector width direction (right-to-left direction as shown in FIG. 13). It should be noted that the circuit board connector (not shown) has a similar configuration of the circuit board connector 30 of the first embodiment.

Next, the use of the cable connector 10' and the circuit board connector with the configurations described above will be explained.

First, the terminal with a cable (not shown) is attached to the housing 11' in the similar manner as in the first embodiment. That is, the terminal to which the cable is crimp is inserted in the terminal hole 12' of the housing 11' up to an appropriate position from a rear portion to a front portion in a state in which the movable member 20' has not been attached to the housing 11'.

Next, as indicated by an arrow in FIG. 13, the movable member 20' is attached to the housing 11' from below the housing 11' to assemble the cable connector 10'. At this time, each of thrust arm portions 25'A and 25'B enters the respective groove portion 18 from a lower portion thereof. Further, each of the thrust arm portions 25'A and 25'B rides over the respective protruding portion 19 to enter inside of the terminal hole 12'.

The thrust arm portions 25'A and 25'B are supported by the protruding portions 19 from below after entering inside of the terminal holes 12'. Further, the distal end faces of the thrust arm portions 25'A and 25'B support a rear edge of the locking portion (not shown) of the terminal in a front-to-back direction.

The cable connector 10' is fitted to the circuit board connector (not shown) from above. Accordingly, the connector assembly may be obtained. After the fitting of the cable connector 10' and the circuit board connector, the movable member 20' receives a backward operating force to retreat. The connector fitting operation and the movement operation of the movable member 20' are basically similar to those in the first embodiment.

In the embodiment, the operating portion 22' has a shape that extends in a connector width direction as shown in FIG. 13 instead of a plate shape as the upper plate portion in the first embodiment. The operating portion 22' receives an operating force in a front-to-back direction directly. Accordingly, comparing with the case in which the operating portion is formed to be a plate shape, a finger can be easily caught in the operating portion, which allows the movable member 20' to be moved in a front-to-back direction with ease.

In the embodiment, the guide protruding bar portion and the guide groove that conforms to the guide protruding bar portion in the second embodiment may be formed to guide a movement of the movable member 20' in a front-to-back direction.

The disclosure of Japanese Patent Application No. 2007-171313, filed on Jun. 29, 2007 is incorporated in the application by reference.

While the invention has been explained with reference to the specific embodiments of the invention, the explanation is illustrative and the invention is limited only by the appended claims.

What is claimed is:

1. A cable connector to be fitted to a mating connector attached to a circuit board, comprising:

a housing including a terminal hole for inserting a cable with a terminal; and a movable member attached to the housing for positioning the terminal at a regular position, said movable member including an attached portion attached to the housing and a pressing portion retained in the terminal hole to be movable to an advance position for positioning the terminal at the regular position, said attached portion including an upper plate portion and a lower plate portion both extending forward from a rear wall portion of the movable member to be guided along a top wall of the housing, said pressing portion including a thrust arm portion extending forward from the rear wall portion and having a pressing surface on a front edge surface thereof, wherein said movable member further includes a position display portion formed in the lower plate portion, said housing further including a confirmation portion formed in the top wall as one of a cut portion and a window portion for exposing the position display portion when the pressing portion reaches the advance position.

2. The cable connector according to claim 1, wherein said position display portion includes a protrusion for engaging the confirmation portion.

3. The cable connector according to claim 1, wherein said housing further includes a locking arm on a front edge side thereof, said locking arm being flexible and having a locking hook for engaging the mating connector, said locking arm further having an operating portion for releasing the locking arm from the mating connector.

4. The cable connector according to claim 1, wherein said movable member is arranged to be movable for a specific distance to a retreat position from the advance position so that the upper plate portion covers the confirmation portion of the housing at the retreat position.

5. The cable connector according to claim 1, wherein said movable member further includes a pressed portion on the rear wall portion for receiving an operating force to move the movable member forward from the retreat position.

6. The cable connector according to claim 5, wherein said pressed portion is provided behind a locking arm of the housing so that the movable member moves forward and the locking arm is disengaged when the operating force is applied to both the pressed portion and the locking arm.

7. A connector assembly comprising:

a circuit board connector to be attached to a circuit board, said circuit board connector including a first housing having a fitting portion and a barrier portion; and a cable connector fitted to the fitting portion, said cable connector including a second housing having a terminal hole for inserting a cable with a terminal and a movable member attached to the second housing for positioning the terminal at a regular position, said movable member including an attached portion attached to the second housing and a supporting portion retained in the terminal hole to be movable for positioning the terminal at the regular position so that the movable member abuts against the barrier portion and stops when the cable connector is incompletely fitted to the circuit board connector, and the movable member becomes movable when the cable connector is completely fitted to the circuit board connector.

8. The connector assembly according to claim 7, wherein said fitting portion is formed in a receiving recess portion for receiving the cable connector in a direction perpendicular to the circuit board while the cable is parallel to the circuit board.

9. The connector assembly according to claim 7, wherein said barrier portion includes a guide portion for guiding a guided portion formed in the movable member from an advance position to a retreat position, said guide portion including a retreat regulation surface abutting against a rear side of the guided portion at the retreat position and an upper regulation surface abutting against a top face of the guided portion.

10. The connector assembly according to claim 7, wherein said barrier portion includes guide portion for guiding a guided portion formed in the movable member from an advance position to a retreat position, at least one of said guide portion and said guided portion including a guide slope so that the guided portion easily moves backward.

11. The connector assembly according to claim 7, wherein said barrier portion includes a slope for abutting against a rear portion of the movable member when the cable connector is fitted to the fitting portion and the movable member does not reach an advance position so that the slope pushes the movable member to the advance position.

12. The connector assembly according to claim 7, wherein said barrier portion includes a guide portion for guiding a guided portion formed in the movable member from a retreat position to an advance position, said guide portion including an advance regulation surface abutting against a front side of the guided portion at the retreat position and an upper regulation surface abutting against a top face of the guided portion.

13. The connector assembly according to claim 7, wherein one of said movable member and said circuit board connector further includes a guide protruding bar portion, the other one of said movable member and said circuit board connector including a guide groove for fitting and guiding the guide protruding bar portion when the movable member moves.

14. The connector assembly according to claim 7, wherein one of said movable member and said second housing includes a guide protruding bar portion, the other one of said movable member and said second housing including a guide groove for fitting and guiding the guide protruding bar portion when the movable member moves.

* * * * *